US009453698B1

(12) United States Patent
Grace

(10) Patent No.: US 9,453,698 B1
(45) Date of Patent: Sep. 27, 2016

(54) PARALLEL CAM SYSTEM FOR AN ARCHERY BOW

(71) Applicant: Grace Engineering Corp., Memphis, MI (US)

(72) Inventor: Nathaniel E. Grace, Port Huron, MI (US)

(73) Assignee: GRACE ENGINEERING CORP., Memphis, MI (US)

( * ) Notice: Subject to any disclaimer, the term of this patent is extended or adjusted under 35 U.S.C. 154(b) by 15 days.

(21) Appl. No.: 14/295,567

(22) Filed: Jun. 4, 2014

Related U.S. Application Data

(63) Continuation of application No. 13/046,101, filed on Mar. 11, 2011, now abandoned.

(60) Provisional application No. 61/313,292, filed on Mar. 12, 2010.

(51) Int. Cl.
*F41B 5/10* (2006.01)
*F41B 5/14* (2006.01)

(52) U.S. Cl.
CPC ..... *F41B 5/105* (2013.01); *F41B 5/10* (2013.01); *F41B 5/1411* (2013.01)

(58) Field of Classification Search
CPC ..... F41B 5/10; F41B 5/105; F41B 5/0094; F41B 5/00; F41B 5/1411; Y10S 124/90
See application file for complete search history.

(56) References Cited

U.S. PATENT DOCUMENTS 3,967,609 A 7/1976 Frydenlund
3,990,425 A 11/1976 Ketchum
4,054,118 A * 10/1977 McKee et al. ..... F41B 5/105 124/25.6
4,368,718 A 1/1983 Simonds et al.
4,455,990 A 6/1984 Barna
4,546,754 A * 10/1985 Smith ..... F41B 5/10 124/25.6
4,561,413 A 12/1985 Jennings
4,770,154 A 9/1988 Cook et al.
4,838,236 A 6/1989 Kudlacek
4,957,094 A 9/1990 Pickering et al.
5,697,355 A 12/1997 Schaffer
6,237,582 B1 5/2001 McPherson
6,360,735 B1 3/2002 Larson et al.
6,446,619 B1 9/2002 McPherson
6,516,790 B1 2/2003 Darlington
6,666,202 B1 12/2003 Darlington
6,688,295 B1 2/2004 Miller
6,792,930 B1 * 9/2004 Kronengold ..... F41B 5/10 124/25.6
6,966,312 B1 11/2005 Larson
6,990,970 B1 * 1/2006 Darlington ..... F41B 5/10 124/25.6
2002/0096159 A1 7/2002 McPherson
2003/0168051 A1 9/2003 Andrews
2005/0268892 A1 12/2005 Gallops
2008/0029075 A1 2/2008 McMurray
2009/0188482 A1 * 7/2009 Strother ..... F41B 5/10 124/25.6
2009/0255520 A1 10/2009 Strother
2009/0288650 A1 11/2009 Batdorf
2010/0051005 A1 * 3/2010 Wilson ..... F41B 5/105 124/25.6
2010/0101549 A1 4/2010 Grace et al.
2010/0252013 A1 10/2010 Miller
2011/0023857 A1 2/2011 Grace

* cited by examiner

*Primary Examiner* — John E Simms, Jr.
(74) *Attorney, Agent, or Firm* — Warner Norcross & Judd LLP

(57) ABSTRACT

An archery bow is provided having a cam assembly including a first bowstring track and a second bowstring track laterally separated by a distance, and adapted to guide different portions of a bowstring. The bowstring tracks can be spaced from one another along an axis of rotation of the cam assembly so that the loads exerted by the bowstring portions are substantially balanced. Accordingly, the loads are inhibited from urging the cam to lean out of vertical alignment and/or twisting the limb. The cam assembly can include a power cable track which guides a cable centered on the axis of rotation, and which is within a central longitudinal limb plane. Large, dynamic loads exerted by the power cable through the cam assembly can be centered to inhibit cam lean and limb torque. A related method of inhibiting limb twist, and a split bowstring also are provided.

1 Claim, 17 Drawing Sheets

PARALLEL CAM SYSTEM FOR AN ARCHERY BOW

BACKGROUND OF THE INVENTION

The present invention relates to archery bows, and more particularly to a cam system and related components for compound archery bows.

Conventional compound archery bows include a bowstring and a set of power cables that transfer energy from the limbs and cams or pulleys, both generally referred to as "cams" herein, of the bow to the bowstring, and thus to an arrow shot from the bow. The power cables and bowstring may be strung from one cam on one limb to another cam on another limb of the bow. The function of the cams is to provide a mechanical advantage so that energy imparted to the arrow is a multiple of that required of an archer to draw the bow.

Generally, there are single cam systems and dual cam systems, with various configurations of each. A single cam system usually includes a single cam mounted on one limb and a single track pulley mounted on the other limb of the bow. One dual cam system includes two cams, each mounted on opposing limbs of a bow. Two cables and a single bowstring are strung between both cams, however, one end of each cable is yoked to an axle upon which a cam rotates. Another variant of the dual cam system, often referred to as a "cam and a half", has one cable connected to a yoke at one end of that cable, and another cable connected to both cams.

One characteristic common to most cam systems, and compound bows in general, is that one or both cams include a single bowstring track within which the bowstring is guided, that is, let out and/or taken up, and at least one additional power cable track within which the upward moving power cable or the downward moving power cable is guided, that is, let out or taken up.

In many conventional cam systems, the bowstring moves in a single plane, and is generally guided in that single plane by the single bowstring track described above. The power cable(s) is/are offset laterally from the single plane in which the bowstring moves, and generally are guided in cable tracks that are offset to the left or right of the single bowstring track from the perspective of an archer holding or drawing the bow. When the bowstring is drawn during a draw cycle, loads are dynamically shifted from the bowstring to the cables. Due to the lateral offset of the power cable track and power cable from the single bowstring and single bowstring track, the cable loads are unbalanced relative to the longitudinal axis or central plane of the limbs. These unbalanced loads typically cause the cam to become overloaded on one side of a balance point, or generally unbalanced about the balance point, which results in a teeter totter effect on the limb, thereby causing it to twist or torque about its longitudinal axis. This problem is exacerbated when a cable guard is employed on the bow because the cable guard further offsets the cables from the limb's longitudinal central plane.

For example, with reference to FIGS. 1 and 1A, a conventional cam, including a bowstring track and a power cable track, is rotatably joined via an axle A to a limb L. The bowstring exerts a bowstring force BF, while the power cables exert power cable forces PCF. During the draw cycle, the bowstring force BF and power cable forces PCF are dynamically transferred, which changes the force distribution about a longitudinal axis/center line of the limb or balance point CL/BP. As a result, the force transfer and subsequent overload on one side of the center line or balance point CL/BP causes the cam to lean to that side, out of vertical alignment with the vertical plane P. The unbalanced cable load usually also causes the limb L to torque or twist an angle ∀ away from the horizontal plane HP as shown. The amount of lateral displacement of the unbalanced cable track to one side of the bowstring track, the vertical plane, or the CL/BP, also can contribute to the level or severity of the cam lean and resulting limb twist or torque.

The cam lean and limb twist generated by conventional compound bow cam assemblies can generate significant stress on the axle components and the bow limbs. Such frequent and significant longitudinal twisting also can accelerate fatigue and breakage of limbs. To compensate for such potential fatigue, some manufacturers make the limbs heavier, however, this typically results in a slower limb, and a slower shooting bow. In addition, the torque can impart an awkward feeling to the archer gripping the bow. This may distract the archer and cause the archer to over compensate when aiming.

The cam lean and limb twist common to conventional cam assemblies also present other issues for an archer shooting the bow. For example, cam lean can cause non-parallel nock travel in the windage or horizontal plane. This can cause inconsistent left and right point of impacts of arrows shot from the bow. Cam lean can also require an archer to position sight pins, of a sight mounted to the bow, off center from the arrow to be shot from the bow. For example, with conventional cam lean issues, archers frequently will mount the sight pins to the left of the center of the arrow on right-handed bows, and to the right of the center of the arrow on left-handed bows. In turn, this can exacerbate windage error and point of impact for longer range shots, and can complicate sight set-up.

While conventional compound bow cams can provide reasonably satisfactory performance, there remains room for improvement to reduce cam lean, bow limb twist and/or excessive cable wear due to the same.

SUMMARY OF THE INVENTION

An archery bow is provided including a cam assembly including a first bowstring track and a second bowstring track laterally separated by a distance, and adapted to guide separate and different portions of a bowstring, for example, during a draw cycle.

In one embodiment, the first bowstring track and second bowstring track form a dual bowstring track cam assembly. The tracks can be substantially parallel to one another, and spaced laterally from one another along an axis of rotation of the cam assembly. The axis of rotation can correspond to an axle upon which the cam assembly is mounted.

In another embodiment, the first bowstring track and second bowstring track can be positioned on opposite sides of a center portion which defines at least one power cable track that is adapted to guide at least one cable. The power cable track can be generally centered within the cam assembly, aligned with a balance point of the cam assembly, and centered relative to an axis about which the cam assembly rotates to balance forces exerted on the cam by the bowstring and/or cable during a draw cycle. Optionally, the power cable track can be aligned with a longitudinal central plane of a limb to which the cam assembly is mounted. Further optionally, the bowstring tracks can be substantially identical to one another as well so as to exert substantially identical forces on the limb, but where said forces are offset from one another.

In still another embodiment, the first bowstring track can be defined by a first bowstring cam, and the second bowstring track can be defined by a second bowstring cam. The first and second bowstring cams can be laterally offset from one another when viewed from the perspective of an archer drawing the bow. Optionally, the first and second cams can be laterally offset and generally equidistant from a preselected balance point defined along an axis of rotation of the first and second bowstring cams, which, in turn can inhibit the cam from excessively leaning or torquing about the balance point during a draw cycle.

In yet another embodiment, the first bowstring cam and the second bowstring cam can be rotatable about a cam axis, and spaced laterally from one another along the axis. The first bowstring cam and second bowstring cam can be joined with one another so that they rotate simultaneously and/or synchronously with one another. For example, the cams can be fixedly joined with one another via fasteners and/or formed as a monolithic unit. Alternatively, the first and second bowstring cams can be unjoined with one another, and synchronously rotatable about the axis of rotation.

In even another embodiment, the first bowstring cam can define a first bowstring let out track that lets out a first portion of the bowstring from the rear of the bow as the bowstring is drawn during a draw cycle. That same track can take up the first bowstring portion when the bowstring is released to shoot an arrow from the bow.

In still yet another embodiment, the second bowstring cam can define a second bowstring let out track that lets out a second portion of the bowstring from the rear of the bow as the bowstring is drawn during a draw cycle. That same track can take up the second bowstring portion when the bowstring is released to shoot an arrow from the bow.

In yet even another embodiment, the cam assembly can include one or more power cable cams defining one or more power cable tracks. The power cable track can let out a power cable as the bowstring is drawn and/or can take up a power cable as the bowstring is released. The power cable track can be substantially centered on the axis of rotation of the cam assembly, and/or generally aligned with a longitudinal central axis of a limb to which the cam assembly is joined. Optionally, the power cable track can be located between the first and second bowstring tracks. This can result in large, dynamic loads exerted by one or more power cables or the power cable track being centered, to inhibit cam lean and/or limb twist.

In a further embodiment a cam assembly including first and second bowstring tracks can be in the form of first and second cams each defining respective first and second bowstring tracks, where the first and second cams are mounted on upper and lower limbs of a bow to generally form a dual cam compound archery bow.

In a still a further embodiment, a cam assembly including first and second bowstring tracks can be included on a first cam that is mounted to one limb of a bow; and a pulley or half cam can be mounted on the other limb to generally form a single cam compound archery bow.

In yet a further embodiment, where a cam assembly is included on a bow with a pulley, the cam assembly can include a primary first bowstring track and a primary second bowstring track spaced from the primary first bowstring track. A secondary first bowstring track can be located adjacent the primary first bowstring track, and a secondary second bowstring track can be located adjacent the primary second bowstring track. The primary and secondary first bowstring tracks can be located on a first side of a balance point or center of the axis of rotation of the cam assembly, while the primary and secondary second bowstring tracks can be located on a second side of a balance point or center of the axis of rotation of the cam assembly, opposite the first side. Generally, the loads or forces generated by the bowstring on the respective first and second sides can balance one another to inhibit cam lean and/or limb twist.

In even a further embodiment, where the cam assembly is included on a bow with a pulley, the cam assembly can include a power cable track generally between the (a) primary first and second bowstring tracks, and/or (b) secondary first and second bowstring tracks. Optionally, the power cable track can be centered between the primary first and second bowstring tracks, and/or the secondary first and second bowstring tracks. This can result in large, dynamic loads being centered, to inhibit cam lean and/or limb torque. Further optionally, the aforementioned cam assembly can form a five track single cam system.

In even yet a further embodiment, where the cam assembly is included on a bow with a pulley, the cam assembly can include a first bowstring track and a second bowstring track spaced from the primary first bowstring track. The cam assembly can include a power cable track generally between the primary first and second bowstring tracks. Optionally, the power cable track can be centered between the primary first and second bowstring tracks. The power cable track can guide a power cable as well as a portion of the bowstring therein. This too can result in large, dynamic loads being centered, to inhibit cam lean and/or limb torque. Further optionally, the aforementioned cam assembly can form a three track single cam system.

In still yet a further embodiment, a bowstring is provided including a primary bowstring portion that defines a nock location where an arrow can be nocked. The primary bowstring portion can include a looped first end that is joined with a string joiner. To the string joiner, first and second bowstring portions can be joined. These first and second bowstring portions can form a secondary bowstring portion, and can be of sufficient length and thickness to track within respective first and second bowstring tracks of a cam assembly.

In still even a further embodiment, the first and second bowstring portions can be coupled to one another to form a single secondary bowstring portion. The string joiner can define a bore. The primary bowstring portion looped first end can extend around a portion of the string joiner and/or through the bore. The secondary bowstring portion can extend through the bore, thereby joining the primary bowstring portion and the secondary bowstring portion.

In another further embodiment, the primary bowstring portion can include an end that is split to form first and second bowstring portions. These first and second bowstring portions can be of sufficient length and thickness to track within the respective first and second bowstring tracks of a cam assembly.

In still another further embodiment, the primary bowstring portion can include an end that is joined with a yoke, which is further joined with first and second bowstring portions. These first and second secondary bowstring portions can be of sufficient length and thickness to track within the respective first and second bowstring tracks of the cam assembly.

In yet another further embodiment, the bowstring is adapted to extend from a cam assembly, to a pulley, and back to the cam assembly. The bowstring includes a primary bowstring portion that defines a nock location where an arrow is nocked. To a first end of the primary bowstring portion, first and second bowstring portions, which form a secondary bowstring portion, are joined and adapted to track within the respective first and second primary bowstring tracks of the cam assembly. To a second end of the primary bowstring portion, a tertiary bowstring portion, which extends from the pulley back toward the cam assembly, is joined. The tertiary bowstring portion optionally includes a second end that joins third and fourth bowstring portions, which form a quaternary bowstring portion. These third and fourth bowstring portions can be joined and adapted to track within the respective first and second secondary bowstring tracks of the cam assembly.

In even another further embodiment, the bowstring portions can each terminate at a terminal end. Each terminal end can include an attachment loop that is joinable with a protrusion, fastener or other corresponding structure to anchor the terminal ends to the cam assembly sufficiently.

The compound archery bow, cam assembly and bowstring described herein can provide a simple, well-balanced construction that inhibits or reduces cam lean, bow limb twist and/or excessive cable wear due to the same. The construction can also ensure straight nock travel for arrows propelled by the bowstring in a windage or horizontal plane. This can result in more consistent arrow flight in the windage or horizontal plane, which can reduce the likelihood of an arrow shot from the bow impacting left and/or right of a desired impact point—even in extreme temperatures where the limb to which the cam assembly is attached may function differently.

In addition, the construction can be forgiving on proper bow shooting form, as well as grip, as it is usually more difficult to improperly torque a bow including the construction. Further, when using the construction, the sight pins of a sight can simply be aligned with the centerline of an arrow and/or the bowstring, which can facilitate sight installation and sighting in of the bow. Finally, the multi-track cam assembly and bowstring described herein can be used on any bow, including but not limited to a single cam system, a cam-and-a-half system, two-track binary cam system, a three-track binary cam system, a traditional dual cam system of a current embodiment, an eccentric axle dual cam system and/or any other cam or pulley system that is provided on an archery bow. This versatility makes the construction widely applicable to virtually all types of bows.

These and other objects, advantages, and features of the invention will be more fully understood and appreciated by reference to the description of the current embodiment and the drawings.

DETAILED DESCRIPTION OF THE CURRENT EMBODIMENT

Figure 1:
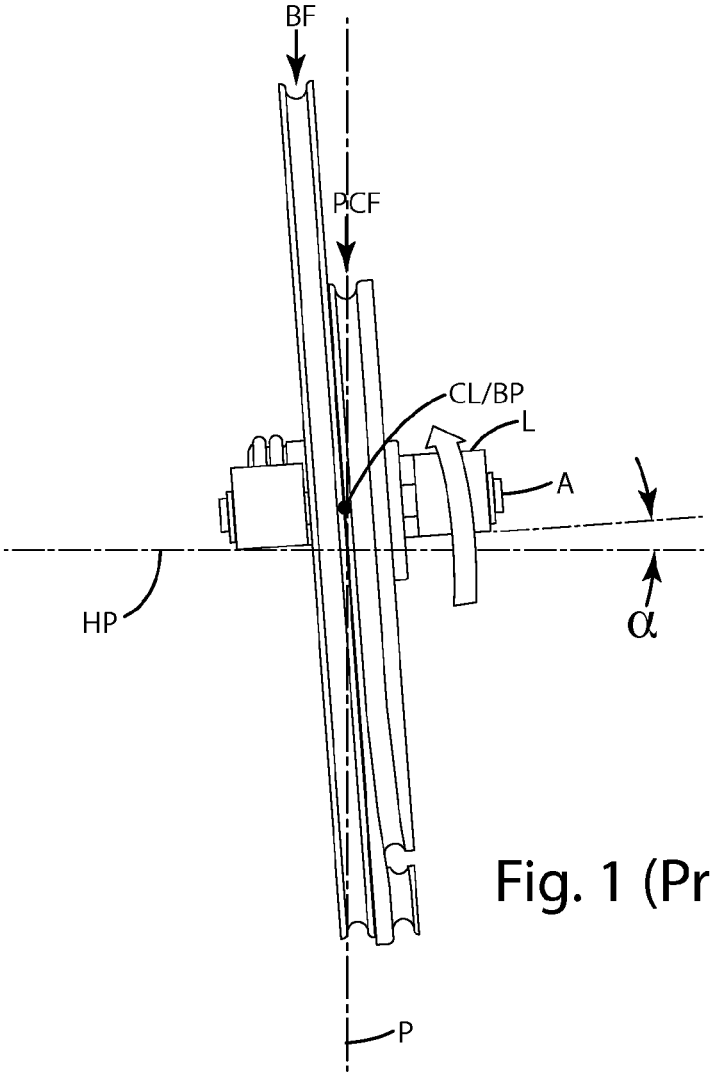
Fig. 1 (Prior Art)
FIG. 1 is an end view of a prior art cam assembly mounted on a compound bow.
Figure 1A:
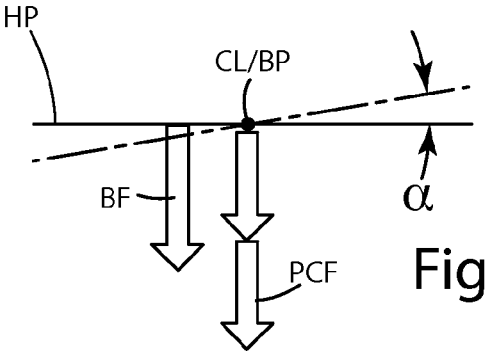
Fig. 1A (Prior Art)
FIG. 1A is an illustration of loads exerted by the prior art cam assembly.

A compound archery bow including a cam system and a bowstring in accordance with a current embodiment is illustrated in FIGS. 2-9 and generally designated 10. The cam system can include lower 20 and upper 50 cam assemblies, which can form a dual cam system on the bow 10. The upper cam assembly 50 can be mounted to an upper limb 15 and the lower cam assembly 20 can be mounted to the lower limb 14 of the bow 10. The upper and lower limbs can be joined with the riser 16 of the bow, and spaced apart from one another in a desired configuration. In the current embodiment of a dual cam bow, the upper and lower cam assemblies can include generally the same components, and can operate in a similar manner. Accordingly, only the upper cam assembly 50 will be described in significant detail herein, with the understanding that the lower cam assembly 20 can include the same components and can operate in a similar manner in this embodiment and other embodiments herein.

Although the current embodiment of FIGS. 2-9 is described in connection with a dual cam bow, the cam assemblies 20, 50, bowstrings, cables and other features are suited for use with simpler pulley systems, for example, in single cam systems, which are described in connection with the alternative embodiments herein. The cam assembly, bowstrings, cables and other features also can be used in other dual cam, cam and a half, and single cam systems as well. Further, the embodiments herein are well suited for cam assemblies of single cam compound archery bows, dual cam bows, cam and a half bows, crossbows and other archery systems including a cam and/or a pulley.

As used herein, a "cam" refers to a cam, a pulley, and/or an eccentric, whether a modular, removable part, or an integral part of a cam assembly, for use with an archery bow.

As used herein, "inhibit" refers to preventing, impairing and/or reducing a certain event, action, result, force, torque, twist and/or activity. As used herein, a "track" refers to a structural element that is adapted to guide or accommodate a portion of a bowstring or power cable within or adjacent the element, and can be in the form of a groove, a recess, a slot, pins or posts extending from or defined by a surface or element. When in the form of a groove or recess, that element can be defined by a part of a cam assembly, and can be of virtually any geometric cross section, for example, partially or fully semi-circular, rounded, triangular, rectangular, square, polygonal, or combinations of the foregoing.

Figure 2:
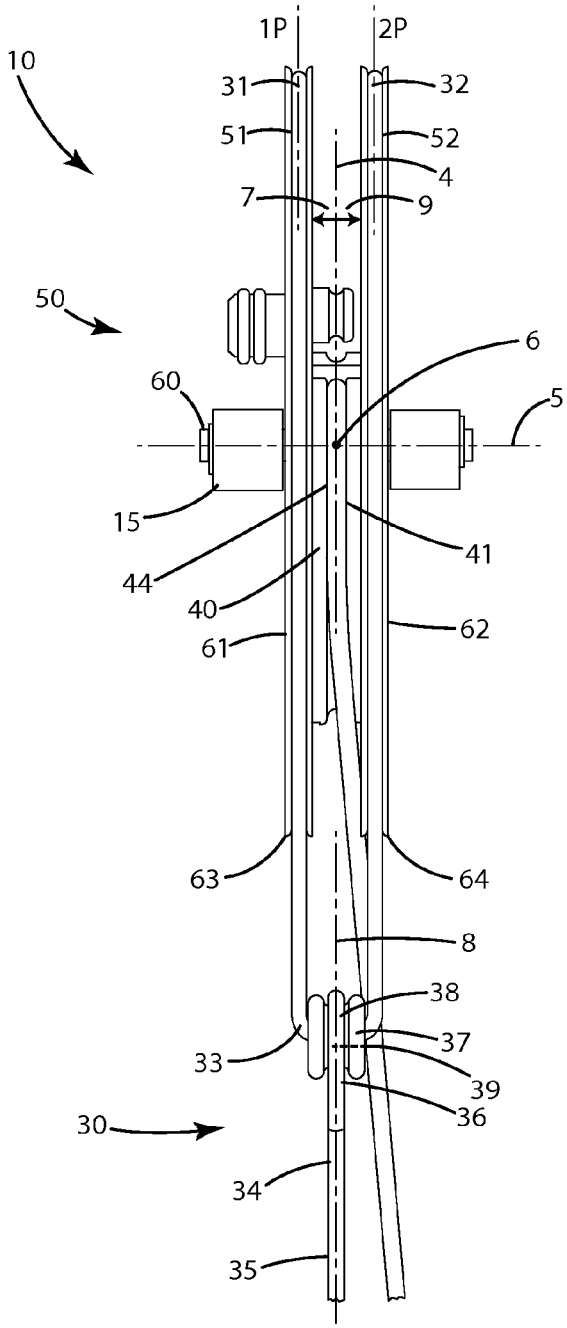
FIG. 2 is an end view of a current embodiment of a cam assembly mounted on a compound archery bow.

As used herein, an "axis of rotation" refers to an axis about which a cam can and/or does rotate, for example, an axis 5 as shown in FIG. 2. This axis can coincide with the center of the axle 60 if desired. Further, the "center" of the axis of rotation, identified in FIG. 2 as center 6, can substantially correspond to the center of the axle located midway between the ends of the axle, or it can substantially correspond to the location at which the axis 5 intersects a longitudinal central plane 4 of a limb 15 of the bow 10.

Although not described in detail, the cam assemblies herein can include modular elements that provide some level of adjustment of a performance characteristic of a bow, including but not limited to, a particular draw length, draw stop or draw force for the bow. The assemblies also can include draw stops and other components common to cams as desired.

Turning now to the current embodiment of the bow 10, the cam assembly 50 includes a first bowstring cam part 51 and a second bowstring cam part 52. The first and second bowstring cam parts 51, 52 can form the outer portions of the cam assembly 150. The cam parts 51, 52 can be mirror images of one another, with identical peripheral sizes and/or shapes. The cam parts can be generally perpendicular to the axis of rotation 5, and can be located in planes 1P and 2P that are substantially parallel to the longitudinal central plane 4, as well as the plane 8 in which the bowstring is located in its undrawn state, and/or in which the bowstring generally moves during its draw and/or release cycle.

The bowstring cam parts 51, 52 can be in the form of individual cams that are joined together with one another, and optionally other elements such as a power cable cam 30, via fasteners such as screws, rivets, welds, and other fastening structures. Alternatively, the cam parts can be in the form of a monolithic, continuous single piece structure that includes the cam parts and the respective features thereof.

The cam assembly 50, and the respective cam parts and components, for example the portions that define the bowstring tracks and power cable tracks as described below can be constructed from a rigid metal, polymeric, and/or composite structure, and can have a generally volute peripheral shape. Optionally, the cam assembly can be machined from metal, such as aluminum, magnesium or titanium, metal injection molded, and/or formed from a composite material with suitable properties.

As shown in FIGS. 3-6, the bowstring cam parts 51 and 52 respectively can define a corresponding first bowstring track 61 and second bowstring track 62. These bowstring tracks can extend along a sufficient portion of the periphery of each of the first and second bowstring cam parts 51 and 52, and can be of a preselected curvature to provide desired performance characteristics of the cam assembly 150. For example, the bowstring tracks can follow a generally volute shape as shown, or if desired, they can follow a rounded or circular shape, or some other predefined shape depending on the operating and performance characteristics of the bow. Further, although only two bowstring tracks are shown, additional bowstring tracks may be added as described below.

The first 61 and second 62 bowstring tracks can lie in the respective planes 1P and 2P, which are generally perpendicular to the axis 5 of rotation of the cam assembly. Each track 61, 62 can also include respective bowstring let out portions 63, 64, from which the respective first and second bowstring portions 31 and 32 can be let out from when the bow 10 is drawn during a draw cycle. The bowstring let out portions can be contiguous with the remainder of the respective bowstring tracks as shown, or can be segmented or separate from the remainder of the bowstring tracks if desired.

Figure 4:
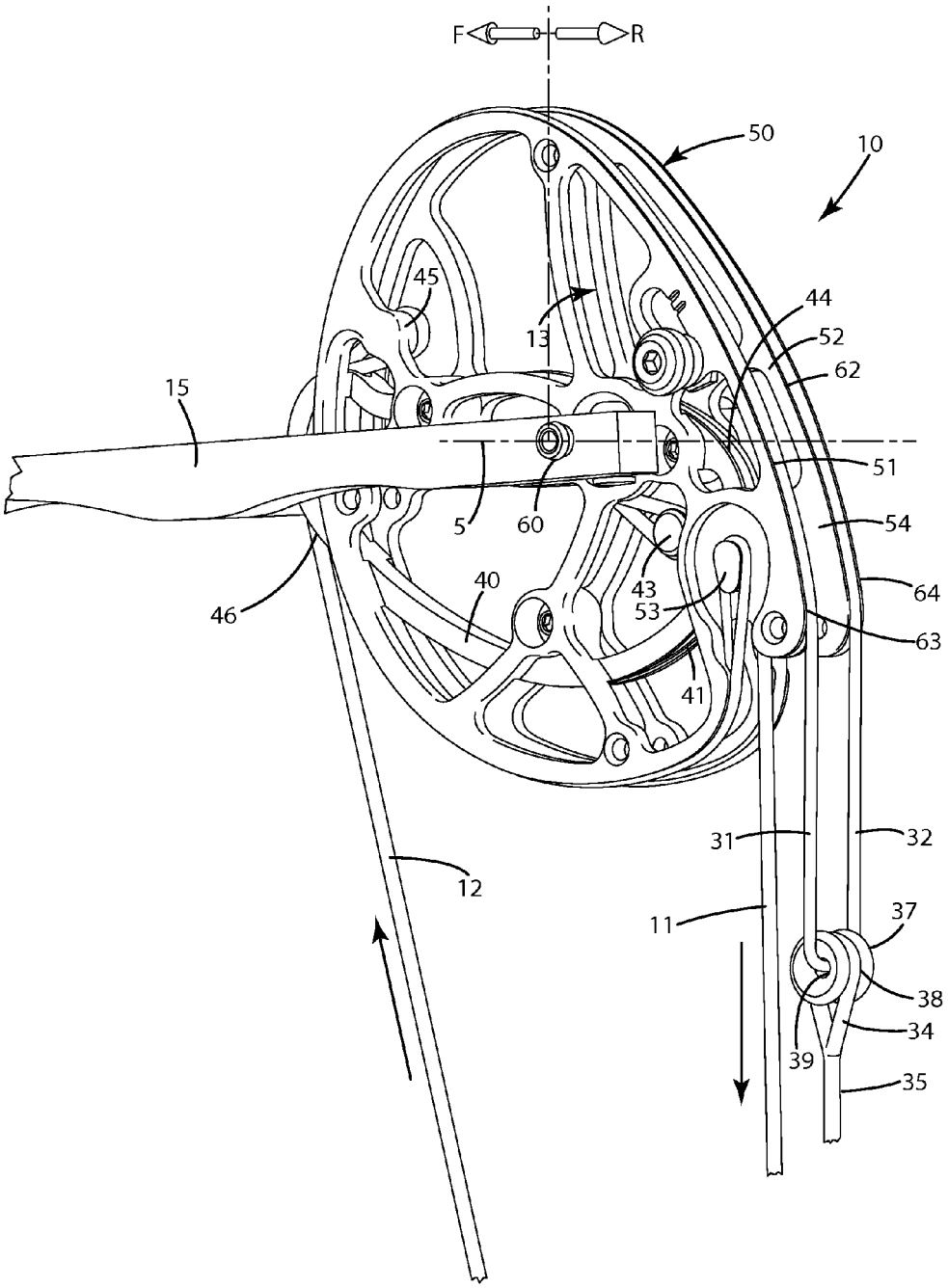
FIG. 4 is a rear perspective view of an upper cam assembly mounted to the upper limb of the bow.
Figure 5:
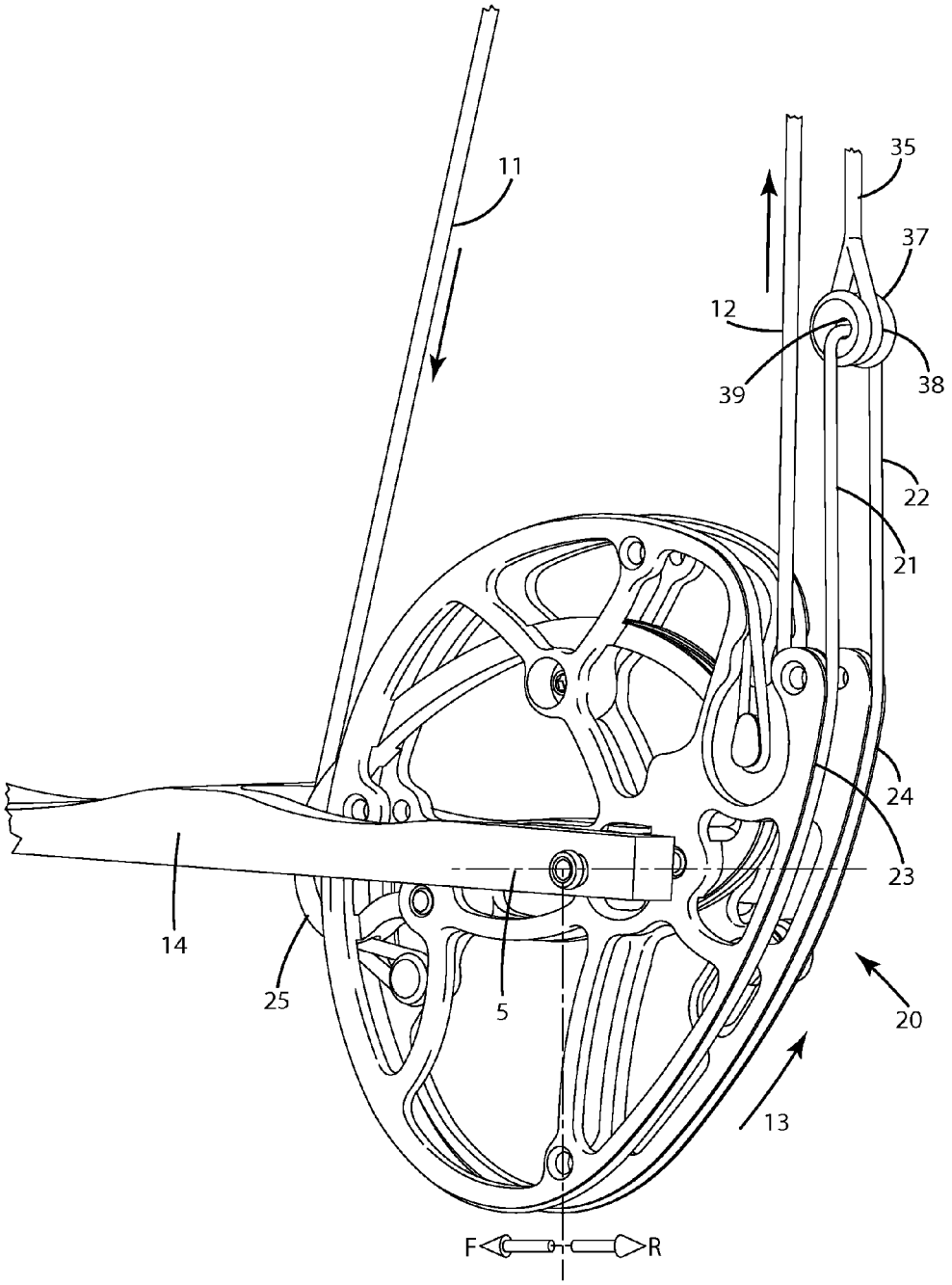
FIG. 5 is a rear perspective view of a lower cam assembly mounted to the lower limb of the bow.

As shown in FIGS. 4 and 5, the bowstring tracks 61 and 62 can extend from a location rearward R of the axis 5 of rotation, forwardly past the axis of rotation 5, to a location forward F of the axis 5 of rotation. Optionally, the let out portions 63, 64 of the respective bowstring tracks can be located rearward R of the axis 5 of rotation when the bow 10 is in an undrawn state, or generally when the bowstring 30 has not yet been drawn. With this construction, the bowstring portions 31, 32 are generally let out rearwardly from the bow 10, that is, they are both rolled off the cam assembly 50 toward the rear R of the bow, and generally toward an archer drawing the bow 10.

The first 61 and second 62 bowstring tracks can extend around at least a portion of the respective cam parts 51 and 52. The bowstring tracks can be aligned with or otherwise in sufficient proximity to a corresponding bowstring anchor or posts 53, 54 so that the respective bowstring portions 31 and 32 can be joined with those bowstring anchors and secured to the cam assembly 50. The bowstring posts or anchors may be integral parts of the cams in proximity to the respective first and second bowstring tracks. Optionally, the integral posts can be replaced with non-integral anchors that are joined with the cams using a conventional fastener or as an applied attachment thereto.

The cam assembly 50 can be rotatably mounted on the limb 15 via an axle 60 that projects through an aperture 63 (FIG. 8) defined by the cam assembly 50. In general, the cam assembly can be adapted to rotate about the axis of rotation 5. The axle 60 can be an integral part of the cam assembly, or can rotate with the cam assembly, or can be configured so that the cam assembly rotates about the axle. Optionally, the axle and/or limb can include suitable bearings to enhance rotation of the cam assembly 50. Suitable bearings include, but are not limited to, bushings, roller bearings, and ball bearings.

The first bowstring track 61 and second bowstring track 62 can be configured so that they are substantially parallel to one another. For example, when lying in the respective planes 1P and 2P, where these planes are substantially parallel, the tracks 61 and 62 can be substantially parallel. Of course, in certain applications, the planes 1P and 2P and/or the respective bowstring tracks 61 and 62 can optionally be offset at a slight angle of about 0.1° to about 15° to one another, and yet still be considered substantially parallel to one another. With the bowstring tracks 61 and 62 substantially parallel to one another, the corresponding bowstring portions 31 and 32 which are described below in connection with the bowstring 30 can likewise travel substantially in the respective planes 1P and 2P when being guided by the respective cam parts 51 and 52. Accordingly, the first and second bowstring portions 31 and 32 can also be substantially parallel to one another when the bowstring 30 is mounted on the bow 10.

Where the first cam part 51 and second cam part 52 are substantially parallel with one another, all of their components can also be substantially aligned. For example, the cross bracing and additional structural members can be aligned with one another such that the first cam part 51 and second cam part 52 generally mirror one another across the longitudinal central plane 4. Of course, if variance is desired between the respective first cam part 51 and second cam part 52, the structures and components of those parts can be altered to provide the desired performance or aesthetic characteristics.

The first cam part 51 and second cam part 52 can be substantially identical to one another in size and/or shape, and further, the first bowstring track 61 and the second bowstring track 62 can be substantially identical to one another in size and/or shape. For example, the first and second tracks can be substantially mirror images of one another, and/or can be of the same, identical shape and size. With such a construction, the bowstring portions 31 and 32 can let out and be taken up in substantially identical manners. Further, with such a construction, the forces or loads exerted by the bowstring portions on the respective tracks, and subsequently through the axis of rotation and the limb, can be substantially identical. In this manner, the bowstring tracks evenly or similarly and evenly load the limb during the draw cycle and/or when the bow is at full draw, which can inhibit limb twist. Optionally, any of the other bowstring tracks of the other embodiments herein can also be substantially identical in size and shape to one another.

Figure 6:
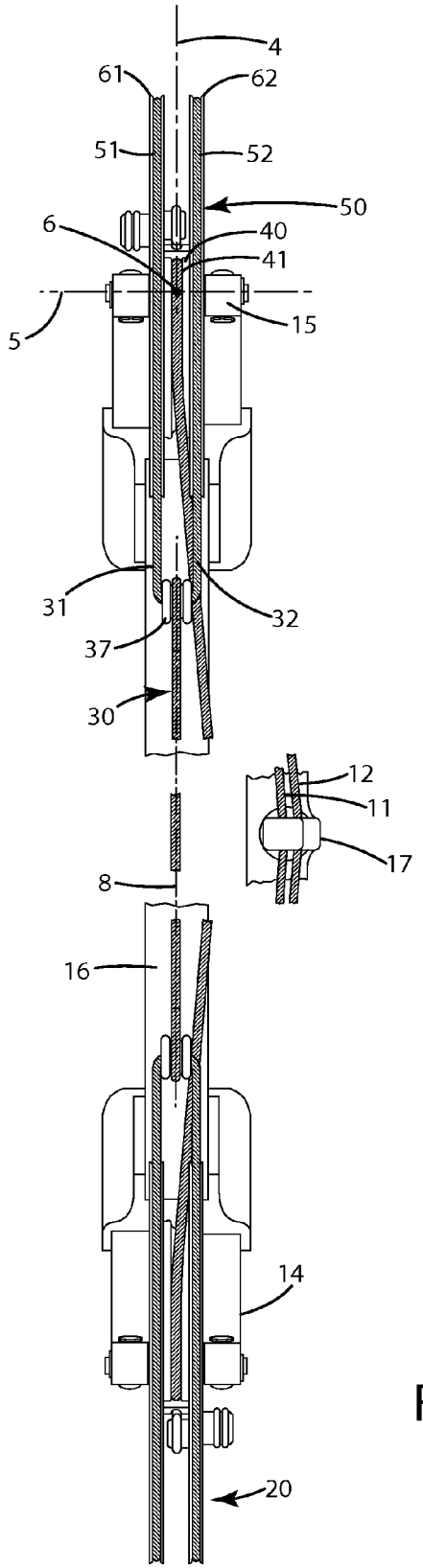
FIG. 6 is rear view of the bow with the cam assemblies mounted on the upper and lower limbs.
Figure 7:
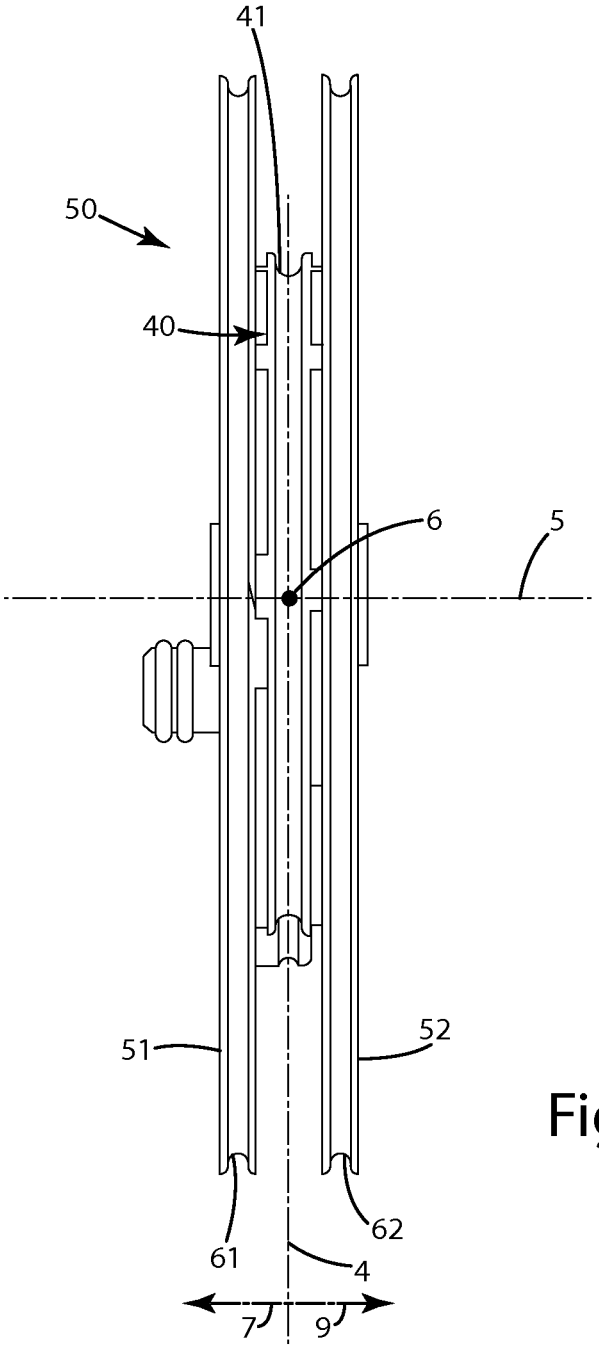
FIG. 7 is a front view of the upper cam assembly.

As shown in FIGS. 2, 6 and 7, the cam part 51 and corresponding first bowstring track 61 can be laterally offset from the second cam part 52 and second bowstring track 62 along the axis of rotation 5. For example, with reference to FIG. 2, which generally shows the cam from the perspective of an archer holding the bow from the rear of the bow, the first cam part 51 and corresponding first bowstring track 61 can be laterally offset a first lateral distance 7 to the left of the longitudinal central plane 4 and/or center 6. The second bowstring cam part 52 and corresponding bowstring track 62 can be laterally offset a second distance 9 from the longitudinal central plane 4 and/or center 6.

Optionally, the first cam part 51 and first bowstring track 61 can be laterally offset a first distance 7 that is substantially equal to the second distance 9 by which the second cam part 52 and second bowstring track 62 are offset from the center 6 of the axis of rotation 5. This center of the axis of rotation can correspond to the intersection of the longitudinal central plane 4 of the limb with the axis 5 of rotation, or generally the center of the axle 60.

In the configuration as shown, the orientation of the axis 5 of rotation can be such that the axis 5 is transverse, perpendicular, or more particularly, orthogonal to the longitudinal central plane 4 of the limb 15. The longitudinal central plane 4 of the limb can generally correspond to a plane that intersects the upper and/or lower surfaces of the limb 15 and is generally perpendicular to those surfaces. This longitudinal central plane 4 can be coincident with or aligned with a center line of the limb that bisects the limb 15 into opposing left and right sides and viewed from the rear of the bow. Optionally, where the limb is of a varying cross section along its length and has different torque or twist characteristics due to that varying cross section, the longitudinal central plane can be offset from the exact center line of the limb 15 between opposing sides, but still be considered a longitudinal central plane.

Returning to FIG. 2, the first bowstring track 61 and the second bowstring track 62 can be laterally offset or displaced from one another in such a manner that each of the respective first and second bowstring tracks are equal distance from the center 6 of the axis of rotation 5. The respective first and second cam parts 51 and 52 and the respective first and second bowstring tracks 61 and 62 also can be symmetrically located on opposite sides from the center 6 of the axis of rotation 5.

In those cases where the respective bowstring tracks 61 and 62 are symmetrically located on opposite sides of a center 6, the corresponding loads exerted by the respective bowstring portions 31 and 32 located in and guided by the respective bowstring tracks 61 and 62, or otherwise guided by the first cam part 51 and second cam part 52, can be balanced. For example, referring to FIGS. 2 and 2A, where the first bowstring portion 31 exerts a first bowstring force or load 31F, that first bowstring load 31F can generally balance the corresponding load 32F exerted by the second bowstring portion 32 on the opposite side of the center 6.

As a further example, the first bowstring 31 may exert a torque or moment about the center 6 of optionally +1 to +100 pound feet, further optionally +5 to +25 pound feet, whereas the second bowstring portion 32 can exert a torque about the center 6 of −1 to −100 pound feet, further optionally −5 to −25 pound feet. With these positive and negative torques or moments being equal, they effectively cancel each other out. Accordingly, the net torque or moment exerted about the center 6 is about 0 pound feet, or at least negligible or insufficient to cause the limb 15 to substantially rotate about the center 6. The limb 15 therefore is inhibited from substantially twisting or rotating substantially so that the axis of rotation 5 deviates from the limb reference plane 1. Of course, it is conceivable that with certain fluctuations in temperature, which can affect the properties of the limb 15, upon drawing or during the draw cycle of the bow, the limb 15 may twist or rotate slightly. Even with this twisting, it is considered that the cam assembly 50 generally inhibits twisting of the limb.

As shown in FIGS. 2-7, the cam assembly 50 also can include a power cable cam or part 40. This power cable cam part 40 can be located between the first and second cam parts 51 and 52. The first and second cam parts 51 and 52 can be symmetrically disposed on opposite sides of the power cable cam 40 when viewed from the perspective of an archer drawing the bow 10. The power cable cam or part 40 also can be referred to in this configuration as the center portion of the cam assembly 50.

The power cable cam 40 can be integrally formed and monolithic with the respective first bowstring cam part 51 and second bowstring cam part 52. Optionally, the power cable cam 40 can be fastened with fasteners as described above to the respective first bowstring cam part 51 and second bowstring cam part 52.

Figure 8:
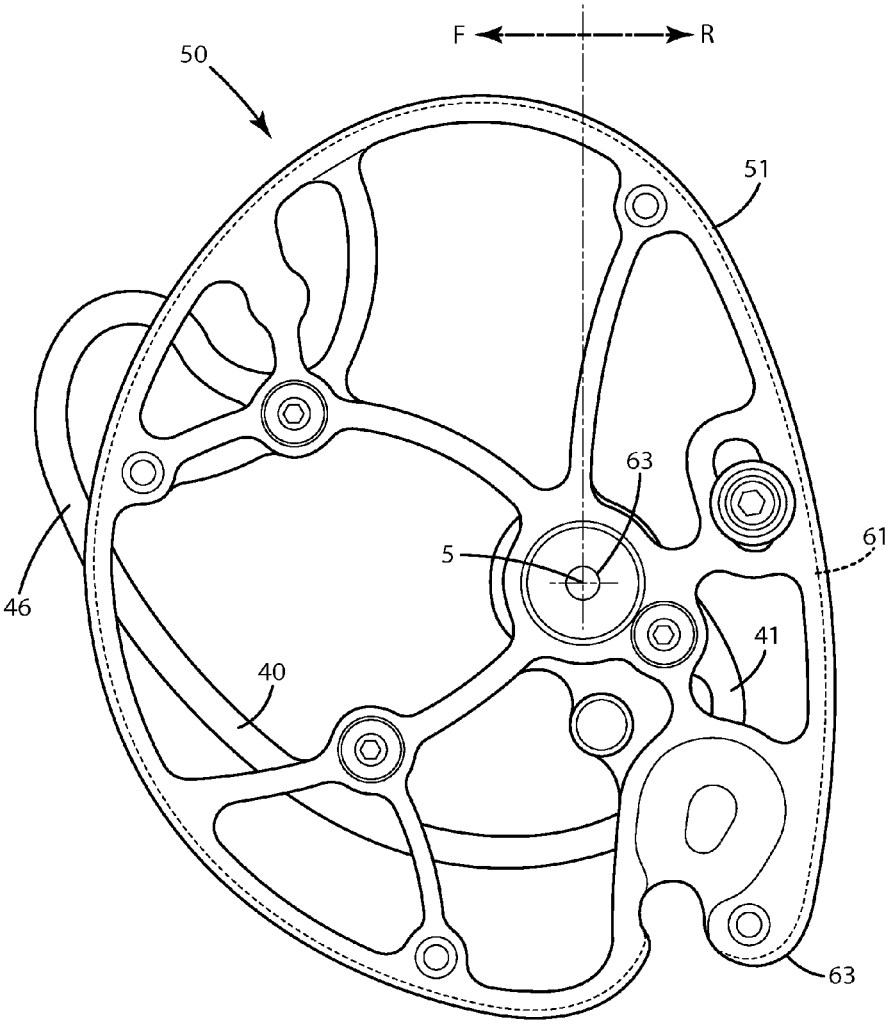
FIG. 8 is a side view of the upper cam assembly.

As shown in FIGS. 4 and 8, the power cable cam 40 can define a power cable track 41, which can be of the same geometric cross section as the respective bowstring cable tracks noted above. The power cable track 41 can include a power cable take up portion 46 and a power cable let out portion 44. The power cable let out portion 44 and take up portion 46 can be contiguous with one another and generally lie within the same power cable track as illustrated. One suitable cable track construction that accommodates different power cables is a single track power cable construction. As described in detail below, the down cable 11 can be let out from the power cable let out portion 44 when the archery bow 10 is drawn and the cam assembly 50 rotates about the axis 60 in the direction 13. Simultaneously and synchronously, the up cable 12 can be taken up by the take up track portion 46 of the power cable track 41.

Optionally, the power cable track 41 can be non-continuous with both the first and second bowstring tracks so that the respective first and second bowstring portions 31 and 32 or primary portion 35 or other portion of the bowstring does not track within the power cable track 41 at any point of the draw cycle of the bow 10. Further optionally, the first and second bowstring tracks 61 and 62 can be non-continuous with the respective power cable track 41 such that no portion of the respective power cables 11 and 12 track within any portion of the first and second bowstring tracks 61 and 62. Of course, in certain embodiments herein or other embodiments, portions of the bowstring can track in the power cable track, or vice versa if desired.

Referring to FIGS. 2 and 6, the orientation of the power cable cam 40 can be such that the power cable track 41 substantially overlaps the longitudinal central plane 4 of the limb 15. For example, the power cable track can lie substantially within the plane 4 or at least can be substantially aligned with it but slightly offset to the left or to the right of the center 6 of the axis 5 of rotation. Optionally, the power cable track 41 can be substantially parallel or be located in the plane 8 in which the bowstring 35 and in particular, the primary bowstring portion 35 travels. Again, the power cable track 41 can be single power cable track that functions as both a take up track and a let out track for the respective power cables 11 and 12 when the bow is drawn through a draw cycle. Of course, the single power cable track 41 can be replaced with two or more additional cable tracks as desired, provided that those cable tracks are symmetrically spaced about the center 6 of the axis of rotation 5 so that the loads exerted by them are substantially balanced about that center 6.

Figure 2A:
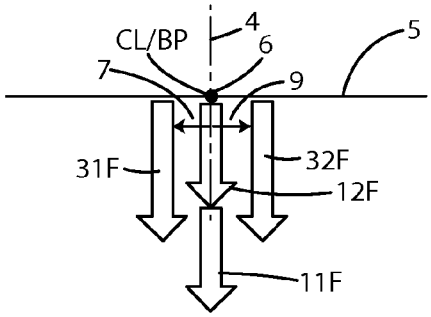
FIG. 2A is an illustration of loads exerted by the current embodiment of the cam assembly.

As shown in FIGS. 2 and 2A, the power cable track 41 can be configured so that loads exerted by the cables 11 and 12 in the track are distributed substantially through the center 6 of the axis of rotation 5 as shown in FIG. 2A. Specifically, loads 11F and 12F corresponding to the loads exerted by the respective power cables 11 and 12 are exerted substantially through the center 6 of the axis 5. Generally, with these loads 11F and 12F being distributed through the center, that loading does not disrupt the balance of the loads 31F and 32F exerted by the bowstring portions. Accordingly, the loads 31F, 32F, 11F and 12F are theoretically balanced about the center 6 of the axis 5 of rotation. As a result, the limb 15 is inhibited from being twisted from the limb reference plane 1, or generally twisting or torquing, as the bow 10 is drawn through a draw cycle.

In conjunction with the above load distribution, a method for inhibiting bow limb twist is also provided. In such a method, the cam assembly 50 can be rotatable about the axis 5. As shown in FIG. 2A, when the bow is at rest or drawn during a draw cycle, the first bowstring 31 and second bowstring 32 apply respective first loads 31F and second loads 32F on opposite sides of the center 6. These first and second loads can substantially balance one another so that the net torque about the center 6 is about 0, or at least negligible so that the limb 15 is inhibited from twisting in such a way that the cam leans out of vertical alignment with the plane of the bowstring 8.

Further in the method, a third load, which can be one or more of loads 11F and 12F, can be applied by the power cables (or another portion of the bowstring as explained in the embodiment below) on the power cable cam 40, these loads can be applied substantially only through the center 6 of the axis 5. As a result, these forces theoretically do not disrupt the balance of the first load 31F and second load 32F exerted by the bowstring portions 31 and 32 respectively. With this construction and its corresponding balance of the loads, the cam assembly 50 can be symmetrically loaded by the bowstrings and power cables so that certain portions of the cam assembly 50 are not overloaded in such a manner so as to twist the limb 15 and/or tilt or lean the cam assembly 50 out of a substantially parallel alignment with the plane 8 of the bowstring 30, and/or with the longitudinal central plane 4.

Optionally, the power cables can join at their ends with cable posts or anchors, provided as integral parts of the respective first 51 and second 52 cams of the cam assembly 50. Alternatively, they can be constructed from fasteners that are fastened to the respective and appropriate portions of the cam assembly 50. The respective power cable track 41 can be located in close proximity to respective anchors 43 and 45 about which the ends of the respective down cable 11 and up cable 12 can be joined in a conventional manner.

The cam assembly 50 can be a monolithic structure or can include multiple cam parts 51, 52 and 40 as described above. The different parts can be secured to one another in a rigid non-adjustable manner. Optionally, the center portion or power cable cam 40 can be in a modular form, and can be adjustably attached to the first and second cam parts 51 and 52. Such an adjustable power cable cam 40 can provide adjustment to accommodate a variety of draw lengths, let offs and other performance characteristics of the cam assembly 50 and archery bow in general. This can be accomplished either by replacement of the complete power cable cam 40 or implementing an adjustable power cable cam module and installing it in the cam assembly 50 at such an adjustable module can be suitable for the cam assembly 50 as disclosed in U.S. Patent Application Publication 2011/0023857 to Grace, which is incorporated by reference by its entirety.

Figure 3:
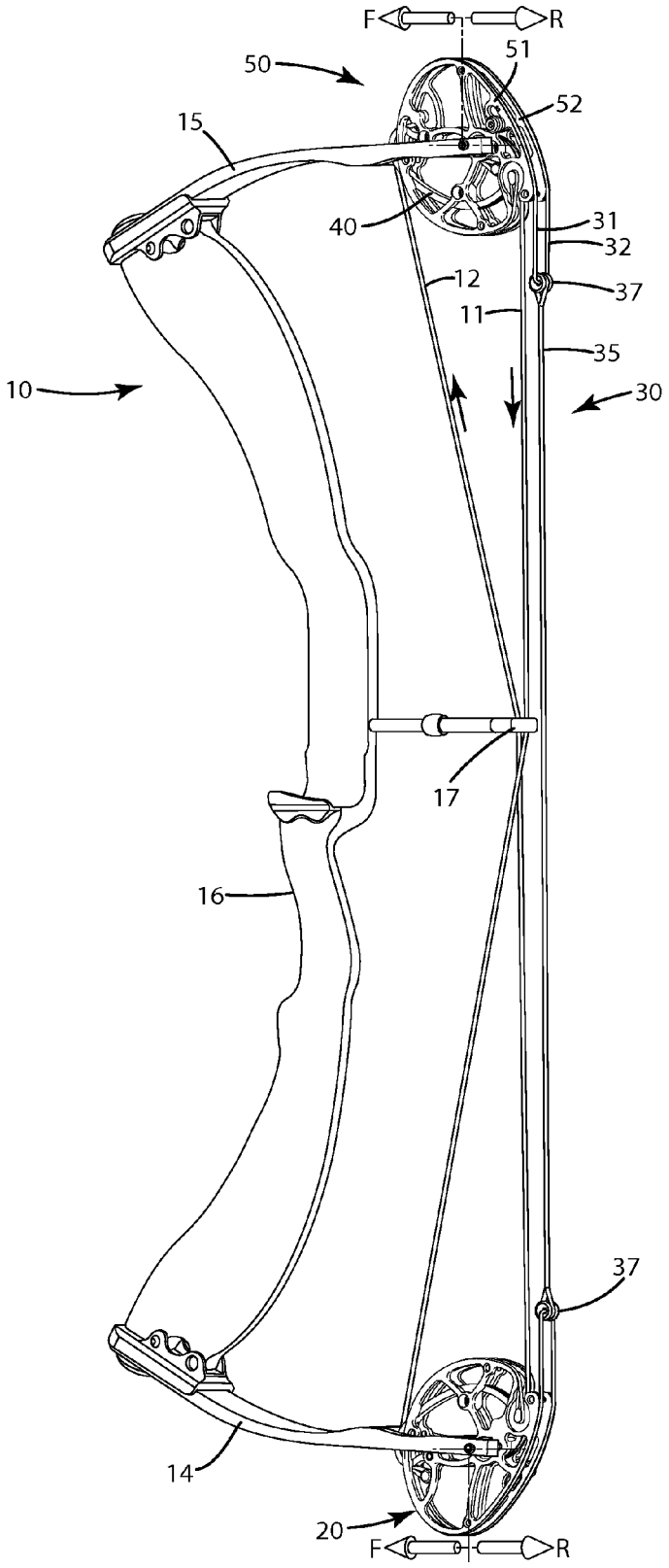
FIG. 3 is a perspective view of the bow including two of the cam assemblies in the form of a dual cam compound bow.

As mentioned above, in the current embodiment, the second cam assembly 20, mounted to the lower limb 14, can be substantially identical to the first cam assembly 50 described above. For example, as shown in FIGS. 3 and 5, the third bowstring track 23 and fourth bowstring track 24 can be substantially identical to one another, and/or the first bowstring track 51 and second bowstring track 52. Likewise, the respective power cable track 25 can be substantially identical to the power cable track 41 described in connection with the first cam assembly. The above noted lateral spacing along the axis of rotation of the cam assembly 20 can also be substantially identical to that of the cam assembly 50 mentioned above.

In general, with the first 50 and second 20 cam assemblies mounted to the bow 10, the bow generally forms a dual cam bow having a single power cable track. The respective power cable tracks of each of the cam assemblies can be located between the respective first and second bowstring tracks. The loads from the respective power cables and first and second bowstring portions are substantially balanced to inhibit twisting of the limbs to which the respective cam assemblies are mounted during a draw cycle and optionally when the bow is in an undrawn state.

During a draw cycle, the bowstring 30 can cause the cam assemblies 50 and 20 to rotate in the direction 13 illustrated in FIGS. 4 and 5 generally toward the archer. When the bow 10 is viewed from the perspective shown in FIG. 3, the upper cam assembly can rotate in a clockwise direction, while the lower cam assembly can rotate in a counter clockwise direction.

As illustrated in FIGS. 3 and 6, the cables are generally centered between the bowstring cam parts 51 and 52, and the first 61 and second 62 bowstring tracks. Accordingly, the bow 10 can include a cable guard and guide 17 to move the respective power cables 11 and 12 out of the plane of the bowstring 8 in the location of the bowstring 30 where the arrow is connected, so that the power cables do not interfere with the trajectory or shooting of the arrow from the bow. The cable guard and guide 17 can pull the cables 11 and 12 out of alignment with the plane 8 in which the primary bowstring portion 35 travels. Even with the power cables pulled away from the bowstring plane 8, much of the lateral forces, and thus torque, generated by the cables 11 and 12 is reduced. In turn, this results in a generally balanced load about the center 6 of the axis so that limb twist is inhibited. This can further reduce wear and tear on the components, such as but not limited to the axle shafts, bearings and bushings (if included), cables and limbs.

Figure 9:
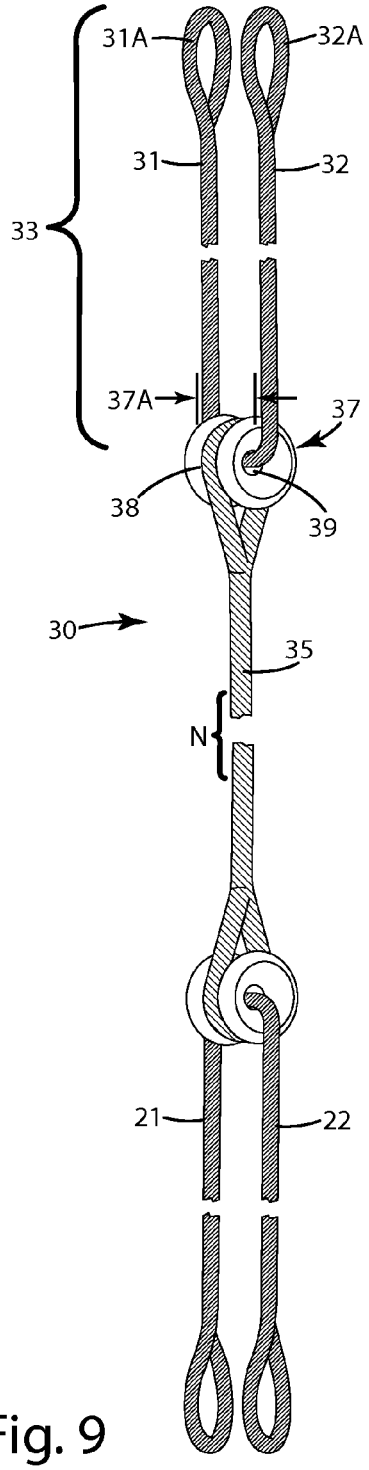
FIG. 9 is a rear perspective view of a bowstring of the current embodiment.

A bowstring 30 that can be used in connection with the archery bow 10 will now be described in more detail. With reference to FIG. 9, the bowstring 30 can include a primary bowstring portion 35. The primary bowstring portion 35 can also define a nocking area N at which an arrow is nocked on the bowstring 30. This nocking area N can vary depending on the particular application and type of archery bow. The primary bowstring portion 35 can include a loop 34. The primary bowstring portion 35 can be joined with first bowstring portion 31 and second bowstring portion 32. This joining may be accomplished via a string joiner 37. The string joiner 37 can include an external groove 38 and also can define a bore 39 which extends through the joiner 37. The loop 34 of the primary bowstring portion 35 can extend around and be seated within the groove 38. Alternatively, the loop 34 can be threaded through the bore 39 as defined by the string joiner 37.

The first bowstring portion 31 and second bowstring portion 32 can be separate pieces, or optionally, can be a single joined piece that forms a secondary bowstring portion 33. The secondary bowstring portion can be threaded through the bore 39 of the string joiner 37. The ends of the secondary bowstring portion 33, 31A and 32A can include loops which can join with respective anchors 53 and 54 of the cam assembly 50 as shown in FIG. 4.

The respective primary bowstring portion 35 and secondary bowstring portion 33 can be constructed from conventional bowstring materials and string. The string joiner 37 can be constructed from a variety of materials including metals, alloys, composites, polymers and/or other materials, and combinations of the foregoing. Generally, the materials can be non-abrasive so that they do not cause excessive wear on the respective components of the bowstring. Further, the bore 39 of the joiner 37 can be of an hour glass shape or rounded on its interior so that to reduce wear and excessive abrasion, and evenly distribute loads of the respective bowstring portions.

The string joiner 37 can be of a width 37A selected so that the first bowstring portions 31 and second bowstring portion 32 are generally aligned with and parallel to the first 61 and second 62 bowstring tracks. Optionally, the width 37A can correspond to the distance between the first 61 and second 62 bowstring tracks of the cam assembly 50 to assist in aligning the bowstring portions with the bowstring tracks.

As shown in FIGS. 3 and 6, when installed on the cam assembly 50, the respective first bowstring portion 31 and second bowstring portion 32 are substantially parallel to one another, optionally both when the bow is in an undrawn state and when the bow is cycling through a draw cycle or in a fully drawn state. Generally, the first bowstring portion 31 and second bowstring portion 32 are substantially parallel to the bowstring plane 8 in which the primary bowstring 35 is drawn. The first and second bowstring portions 31 and 32 also can be offset laterally on opposite first and second sides of the bowstring plane 8, while the primary portion 35 of the bowstring lies and travels or moves within the bowstring plane 8.

With reference to FIGS. 2, 6 and 9, the positioning of the bowstring 30, and in particular, the primary bowstring portion 35 and respective first 31 and second 32 bowstring portions in relation to the cam assemblies is further illustrated. Again, the string joiner 37, due to its width 37A can assist in positioning the first 31 and second 32 bowstring portions in a generally aligned configuration with the first bowstring track 61 and second bowstring track 62. Accordingly, these bowstring portions 31 and 32 can be parallel to and guided within the first and second bowstring tracks 61 and 62. The first and second bowstring portions, making up a secondary bowstring portion 33, can be of a sufficient length to circumferentiate at least a portion of the peripheries of the first and second cam parts 51 and 52. The bowstring portions 31 and 32 can be let out from the respective bowstring tracks as the bow is drawn during the draw cycle. Generally, this let out occurs toward the rear of the bow in a direction generally toward the archer, rather than forward of the bow which is away from the direction of the archer drawing the bow.

Figure 10:
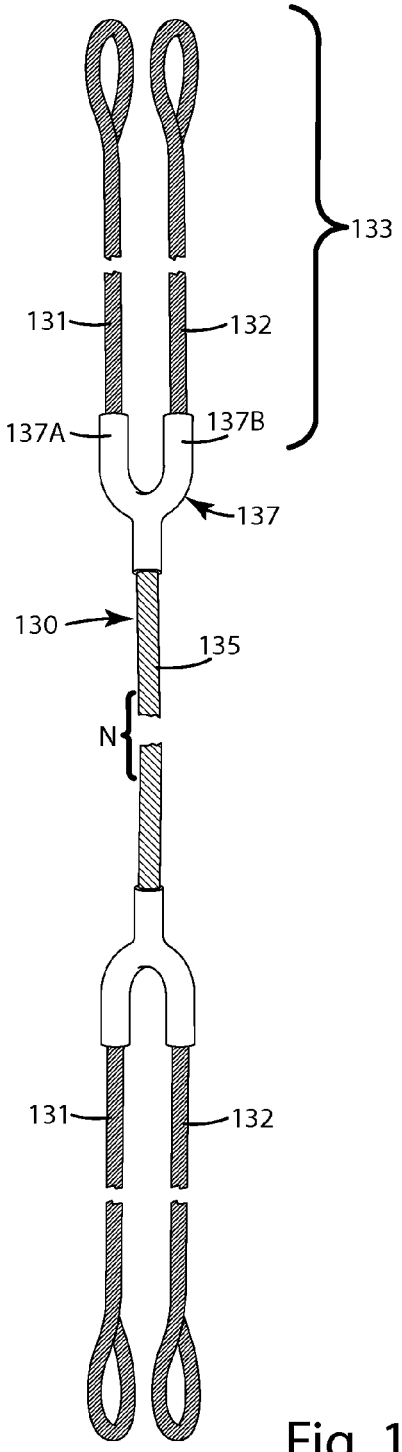
FIG. 10 is a rear perspective view of an alternative bowstring.

An alternative bowstring suitable for use with the embodiments herein is illustrated in FIG. 10. There, the bowstring 130 includes a primary portion 135, a nocking area N and first and second bowstring portions 131 and 132. This embodiment is similar to the bowstring of FIG. 9, however, the first and second bowstring portions 131 and 132 can be joined with the primary bowstring portion 135 with substantially rigid yoke separators 137, generally located at opposite ends of the primary bowstring portion 135. These yoke separators 137 can include split ends 137A and 137B that are generally separated by distance 138 that corresponds to the distance between the respective first and second bowstring tracks 61 and 62. The yoke separators 137 can ensure that the separated first bowstring portion 131 and second bowstring portion 132 follow and are easily fed into the respective bowstring tracks 61 and 62 in the respective cam assemblies 20 and 50.

Although the current embodiment of the cam assemblies and bowstring relates to a dual cam system on a compound bow 10, the cam assemblies and bowstrings are also well suited for a variety of other cam and pulley systems. For example, they may be implemented at a single cam compound bow, with one cam assembly mounted on one limb and a simple pulley mounted on the other limb. The type of cam assembly can vary depending on the desired performance characteristics of the bow. The cam assembly can include different numbers of bowstring tracks. As an example, the cam assembly of a single cam compound bow can be a five track cam assembly, a three track cam assembly, or some other multi-tracked assembly as described below.

Turning to FIGS. 11-15, a first alternative embodiment of the bow including a cam system and a bowstring is illustrated and generally designated 110. This bow, cam system and related cam assemblies are similar to the current embodiment with several exceptions. For example, in this embodiment, the bow is a single cam type, including a cam assembly 150 mounted to the lower limb 114 and a pulley 120 mounted to the upper limb 115.

Figure 11A:
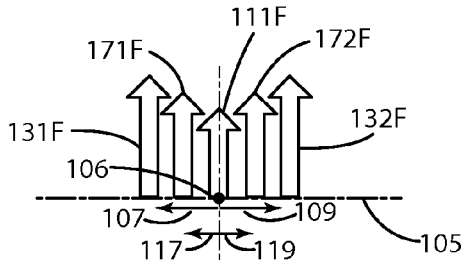
FIG. 11A is an illustration of loads exerted by the first alternative embodiment of the cam assembly.
Figure 11:
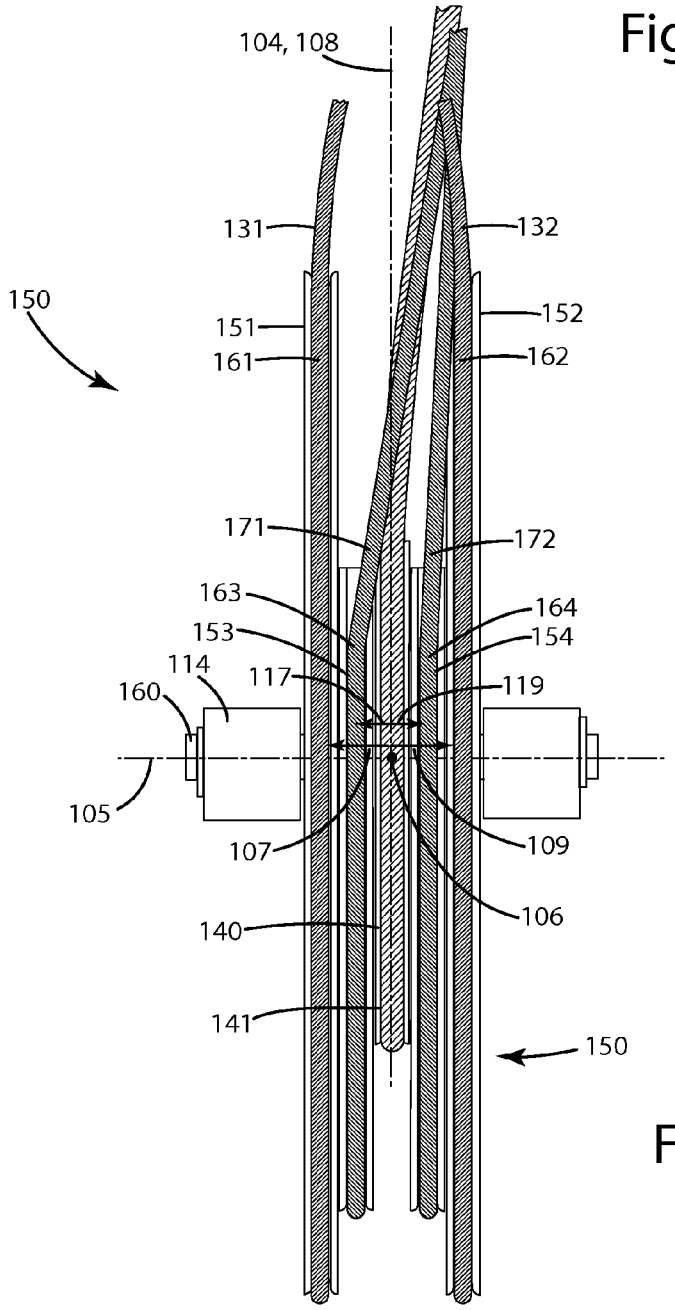
FIG. 11 is a rear view of a first alternative embodiment of a cam assembly for a bow.
Figure 13:
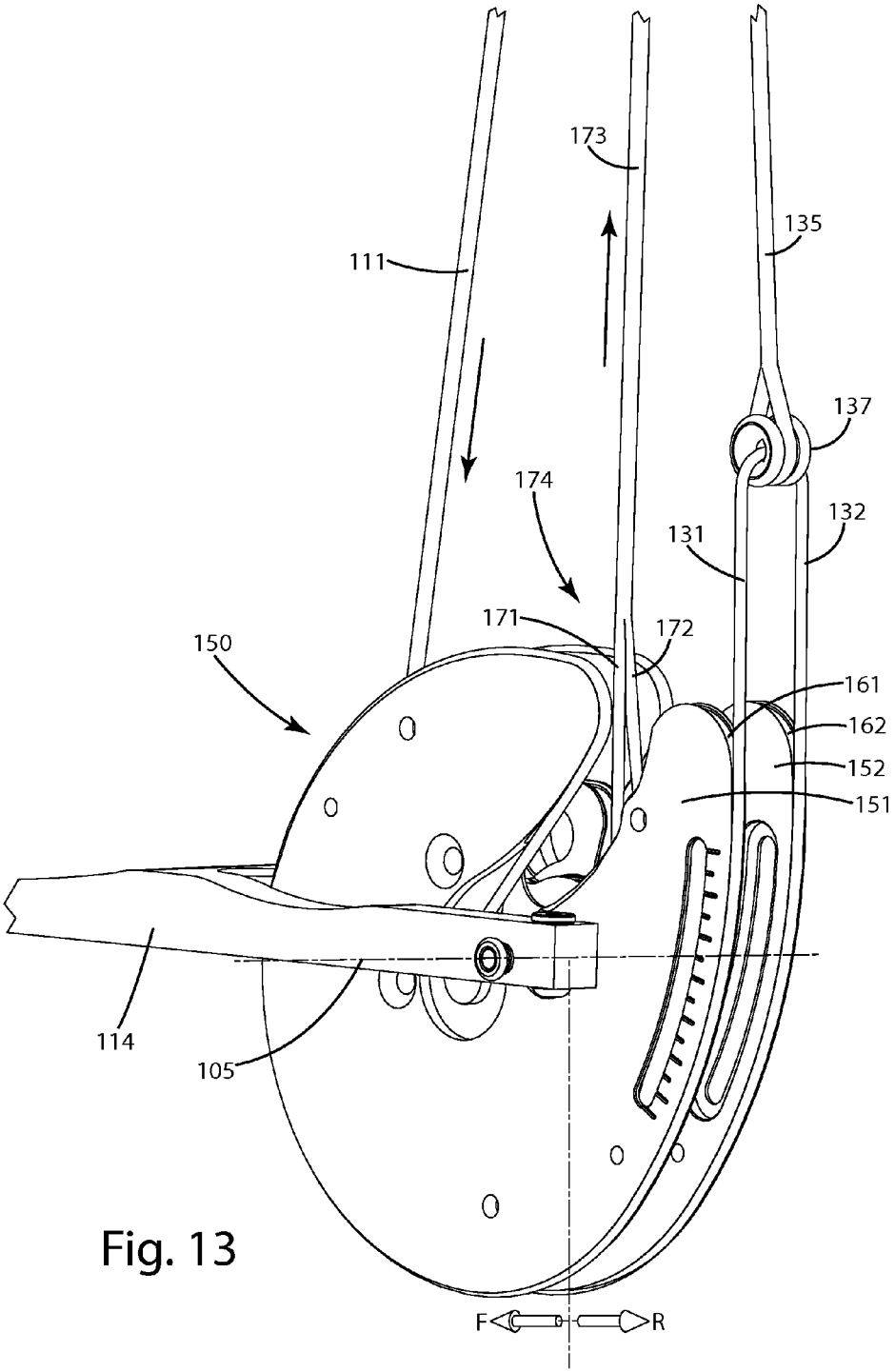
FIG. 13 is a rear perspective view of the cam assembly mounted to the lower limb of the bow.
Figure 14:
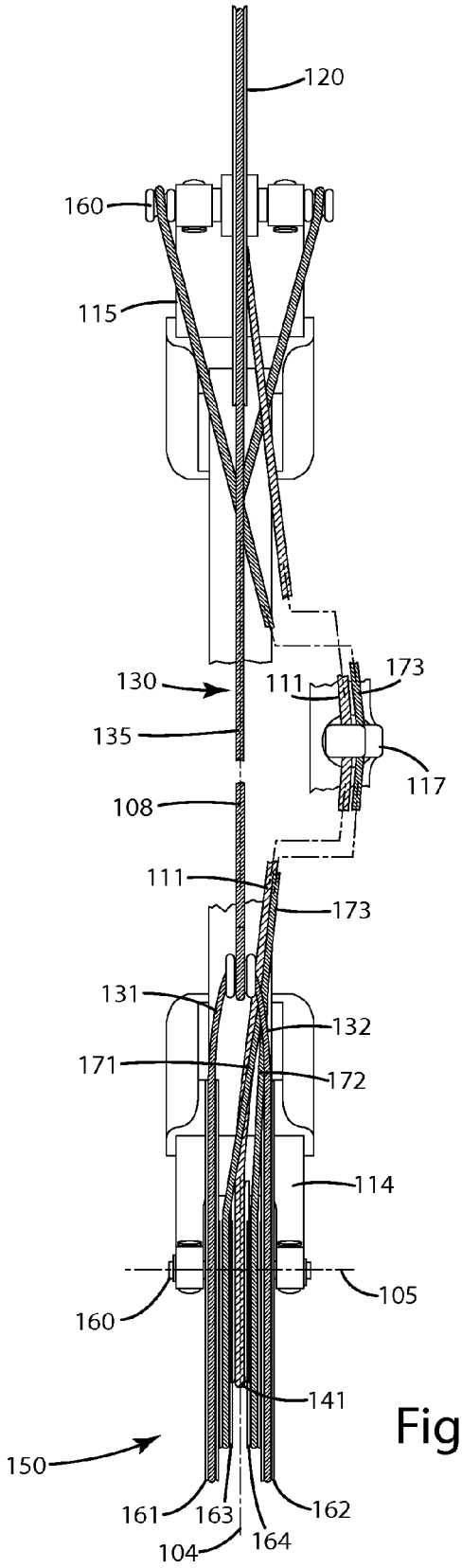
FIG. 14 is a rear view of the compound bow of the first alternative embodiment with the cam assembly mounted to the lower limb and a pulley mounted to the upper limb.

As shown in FIGS. 11, 13 and 14, the cam assembly 150 includes first cam part 151 and second cam part 152 which define first bowstring track 161 and second bowstring track 162. These cam parts and cam tracks can be similar to those described in connection with the current embodiment above in structure and lateral spacing relative to the center 106, along with the balancing of the respective load exerted by the first bowstring portion 131 and second bowstring portion 132. Similarly, the cam assembly 150 can include a power cable cam 140 defining a power cable track 141 as described in connection with the current embodiment above. This power cable track 141 can be generally identical to that of the current embodiment and can be centered on the center 106 of the axis of rotation 105 so that loads distributed by the power cable portion 111 are centered or loaded substantially through the center 106 of the axis of rotation. Likewise, this center 106 of the axis of rotation can be situated and oriented relative to the longitudinal central plane 104 of the limb 114 as described in the current embodiment above.

The power cable cam 140, however, can be configured to only accommodate the down cable 111. In particular, it can be configured to include a take up portion that takes up the down cable 111 when the bow is drawn through a drawing cycle. The power cable 111 itself can be drawn into or taken up by the power cable track 141. In this embodiment, optionally, there is no up cable that is let out from the power cable track 141 as the bow is drawn during a draw cycle.

The cam assembly 150 as shown in FIG. 11 can differ from the current embodiment further in that it can include a third cam part 153 and a fourth cam part 154 which respectively define a third bowstring track 163 and a fourth bowstring track 164. These bowstring tracks can be configured to guide and generally accommodate the third bowstring portion 171 and the fourth bowstring portion 172 that generally form the quaternary bowstring portion 174 of the bowstring 130. These cam parts and bowstring tracks can be similar to those of the first and second bowstring tracks 151 and 152, but optionally of a smaller peripheral size and shape. For example, these bowstring tracks can be of a generally rounded or volute configuration about their periphery, and can be adapted to let out the third 171 and fourth 172 bowstring portions when the bow is drawn during a draw cycle. The third and fourth bowstring tracks 163 and 164 can be identical in size and shape to one another, however, again, can be of a different shape and/or size than the first and second bowstring tracks 161 and 162 to provide a desired performance characteristic.

The third bowstring track 153 and fourth bowstring track 154 can be laterally offset from the center 106 of the axis of rotation 105 by distances 117 and 119 respectively. These third 163 and fourth 164 bowstring tracks generally can be symmetrically displaced on opposite sides of the center 106 of the axis 105. Optionally, the distances 117 and 119 can be equal. Further optionally, these third 163 and fourth 164 bowstring tracks can include let-out portions that let out the respective third and fourth bowstring portions, rearward of the axis 105 if desired.

The bowstring 130 in this single cam system can include a primary bowstring portion 135, a secondary bowstring portion 133 which includes the first and second bowstring portions 131 and 132, a tertiary bowstring portion 173, and quaternary bowstring portion 174 which itself includes third 171 and fourth 172 bowstring portions. The primary bowstring portion 135 can operate as a bowstring, while the tertiary and quaternary bowstring portions 173 and 174 can operate as a power cable. In addition, another power cable 111 can be guided by a portion of the lower cam assembly 150 and can be connected to the axle 160 about which the pulley 120 on the upper limb 115 rotates.

With reference to FIGS. 11 and 11A, similar to the current embodiment described above, the forces or loads generated by the respective first bowstring portion 131F and second bowstring portion 132F can balance one another about the center 106 of the axis of rotation 105. And like the embodiment above, the power cable 111 can apply a load 111F generally substantially through the center 106 of the axis 105 so as not to disrupt the balance of the loads 131F and 132F. The additional bowstring portions 171 and 172 also can apply forces or loads 171F and 172F. As shown in FIG. 11A, however, these loads 171F and 172F also can be balanced about the center 106 of the axis 105, similar to the balancing of the other bowstring loads 131F and 132F. Similar to the current embodiment above, when drawn through a draw cycle, the loads exerted along the axis 105 and thus on the limb 114 by the cam assembly 150 can be substantially balanced with one another to inhibit limb twist and/or cam lean.

Figure 12:
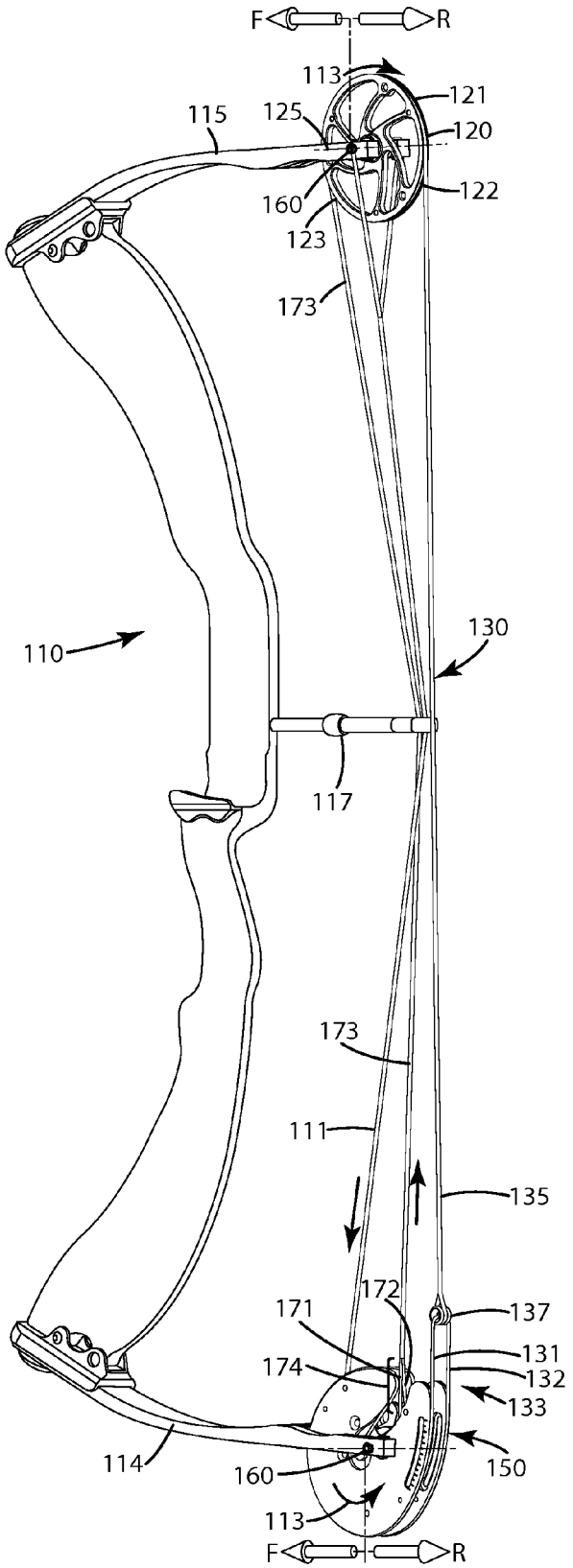
FIG. 12 is a perspective view of the first alternative embodiment of the bow including a single cam assembly and a pulley.

As shown in FIGS. 11, 12 and 14, the first 131 and second 132 bowstring portions are guided by the respective first and second bowstring tracks 161 and 162. These bowstring portions 131 and 132 can extend generally parallel to one another and parallel to the longitudinal central plane 104, as well as parallel to the plane 108 in which the primary bowstring portion 135 moves. The primary portion 135 can extend upward toward the pulley 120 and at least partially around the pulley. Generally, the primary portion 135 can be guided by the pulley 120 and more particularly by the track 121 defined by the pulley 120. The track itself 121 can include a let out portion 122 and a take up portion 123. Optionally, the let out portion 122 can be located rearward R of the axis of rotation 126 of the pulley as shown in FIG. 12. Further optionally, the take up portion 123 of the pulley track 121 can be located forward F of the axis of rotation 126 of the pulley 120.

The bowstring 130 continues around the pulley 120 and transitions to a tertiary bowstring portion 173 that extends downward toward the cam assembly 150 mounted on the lower limb 114. This tertiary portion 173 can extend at least partially through the cable guard 171 which can hold that tertiary bowstring portion 173, as well as the other power cable, to the side of the bowstring plane 108 and/or generally out of the path of travel of an arrow shot from the bow. The tertiary portion 173 can transition to the quaternary bowstring portion 174. The quaternary bowstring portion 174 can include the third bowstring portion 171 and the fourth bowstring portion 172 which, as described above, can be guided by and track within the respective third bowstring track 163 and fourth bowstring track 164.

Figure 15:
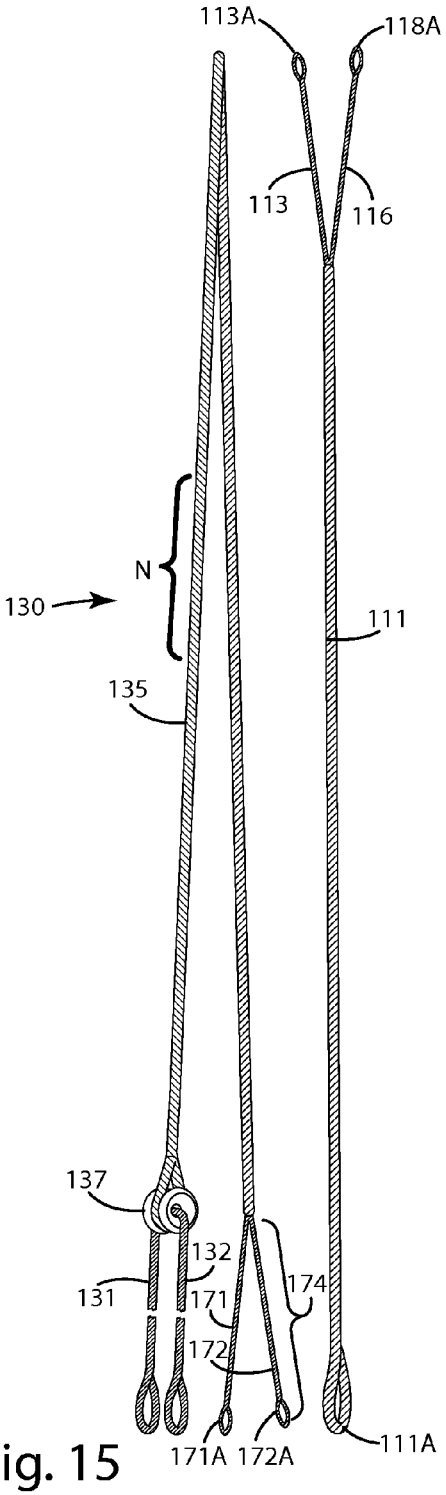
FIG. 15 is a rear perspective view of a bowstring and cable of the first alternative embodiment.

Referring to FIG. 15, the bowstring 130 and power cable 111 of the first alternative embodiment will now be described. Generally, the features and components of the bowstring and cable can be similar to that of the bowstrings described in connection with current embodiment above with several exceptions. For example, the bowstring 130 can include a primary portion 135 that defines a nocking area N where an arrow can be nocked. This bowstring portion can be joined with a string joiner 137 like the string joiner described above. The first bowstring portion 131 and second bowstring portion 132 can be further joined with the joiner 137. The primary portion 135 can further be joined with a tertiary portion 173 of the bowstring, which can generally operate as a power cable. In general, the primary portion 135 extends upwardly around the pulley 120 and the tertiary portion of the bowstring 173 extends downwardly away from the pulley. The tertiary portion can transition to a quaternary portion 174. The quaternary portion can include a third bowstring portion 171 and a fourth bowstring portion 172 which each terminate at respective loops 171A and 172A. As shown in FIG. 15, these loops can join with anchors or posts associated with the third cam part 153 and fourth cam part 154, or some other portion of the cam assembly 150.

The tertiary portion 173 can transition to the quaternary bowstring portion 174 at a Y or V with groups of strands of the tertiary portion 173 separating to form the third bowstring portion 171 and fourth bowstring portion 172. Alternatively, as shown in FIG. 16, the tertiary portion 273 can transition to the quaternary portion 274 via a string joiner 237 in a manner similar to that described in connection with the joining of the first and second bowstring portions and a primary bowstring portion in the current embodiment above.

Returning to the embodiment shown in FIG. 15, the power cable 111 can include a primary power cable portion 111 that transitions to a first cable portion 113 and a second cable portion 116. These first and second power cable portions can terminate at loops 113A and 116A respectively. These loops can be joined with and/or around a portion of an axle 160 that is further joined with the upper limb 115 or otherwise associated with the pulley 120. The lower portion of the cable 111 can terminate at a loop 111A, and can be configured to wrap around and be guided by the power cable track 141 defined by the cable assembly 150.

Figure 16:
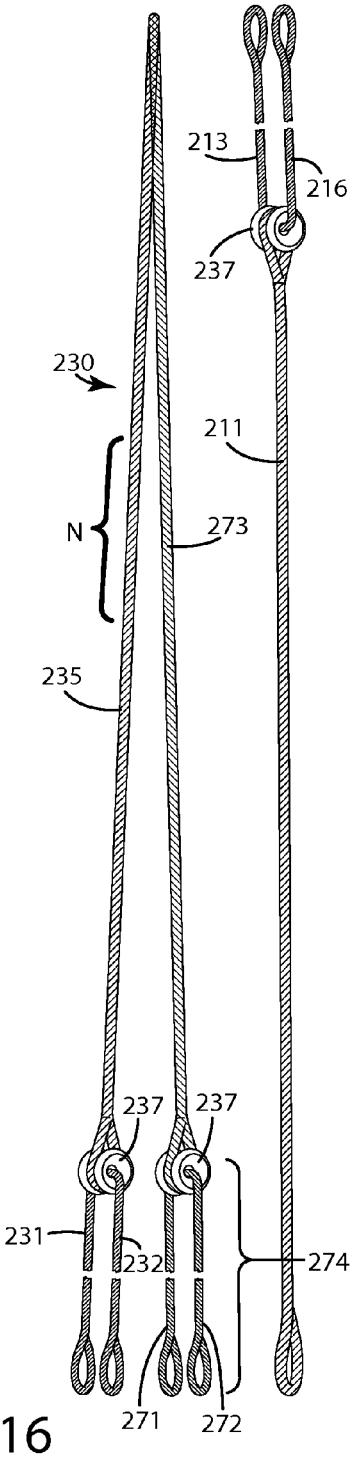
FIG. 16 is a rear perspective view of yet another alternative bowstring and a cable.

An alternative configuration of the power cable is illustrated in FIG. 16 and designated 211. There, the cable 211 can be joined with a joiner 237 in a manner similar to that by which the primary bowstring portion connects to the string joiner. Likewise, the first power cable portion 213 and second power cable portion 216 can be joined with the string joiner similar to a manner in which the first bowstring portion and second bowstring portion are joined with the string joiners in the current embodiment above. Even further alternatively, the yokes described in other embodiments herein can be substituted for the string joiners where it is desired to join a bowstring portion or a cable portion with multiple bowstring portions or multiple power cable portions.

Figure 17:
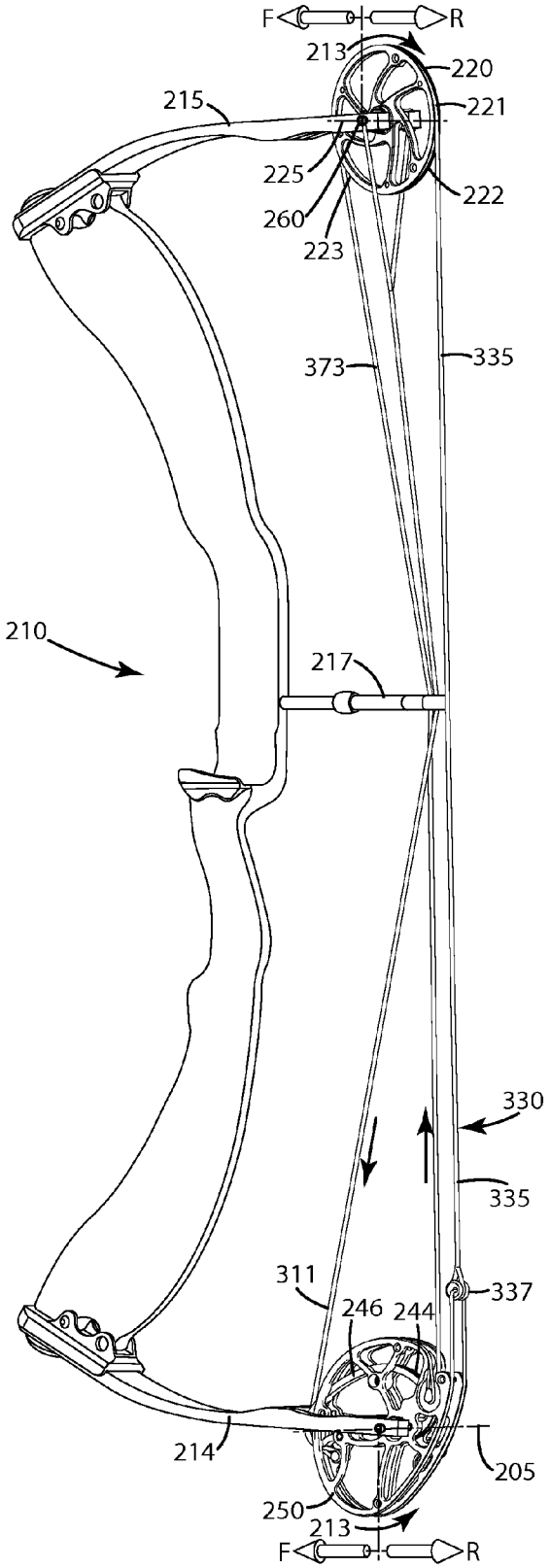
FIG. 17 is a rear perspective view of a second alternative embodiment of the bow including a single cam assembly and a pulley.
Figure 18:
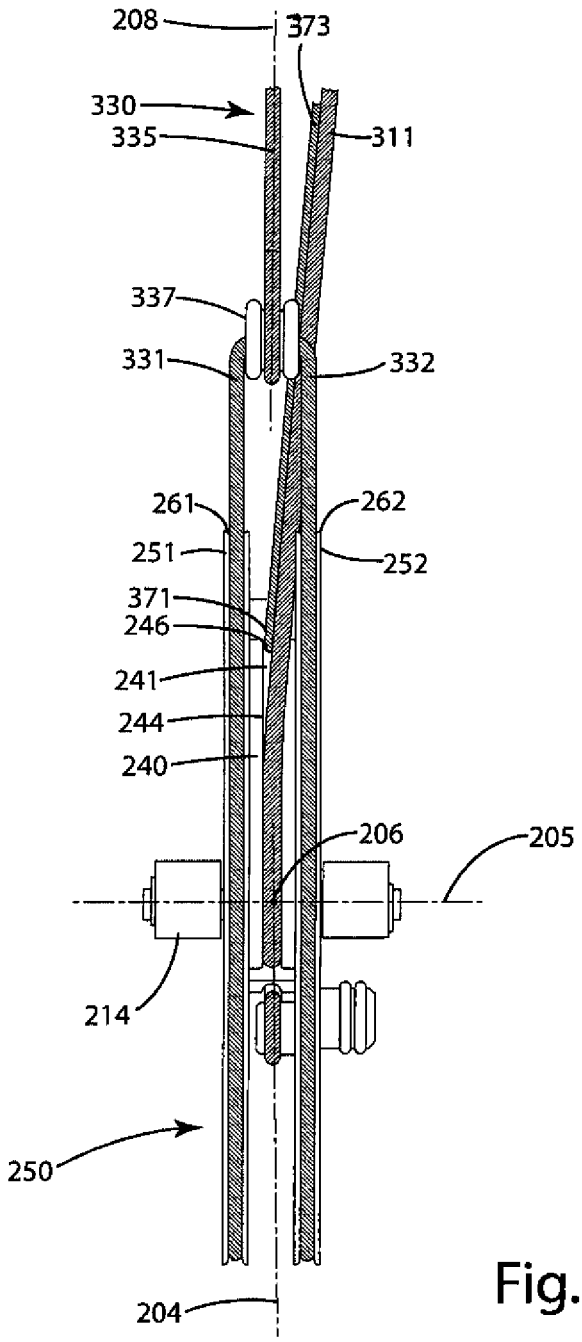
FIG. 18 is a rear view of the cam assembly mounted to the lower limb of the bow of the second alternative embodiment.

A second alternative embodiment of the compound bow, in the form of a single cam compound bow including a three track cam assembly 250 is illustrated in FIGS. 17 and 18. This alternative embodiment is similar in structure and function to the embodiments described above with several exceptions. For example, the bow 210 includes an upper pulley 220, like that of the first alternative embodiment above joined with the upper limb 215, and a cam assembly 250 joined with the lower limb 214. The cam assembly 250, however, can be virtually identical to the cam assembly 50 described in connection with the current embodiment above.

The cam assembly 250 can include a first cam part 251 and second cam part 252, each defining respective first bowstring track 261 and second bowstring track 262. The cam assembly 250 also can include a power cable cam 240 defining a power cable track 241. The bowstring tracks 261 and 262 can be laterally offset from one another and generally disposed symmetrically on opposite sides of the center 206 along the axis of rotation 205. Like the embodiments above, this configuration can balance the loads exerted by the respective bowstring and cables. The power cable track 241 can likewise be aligned with or overlap to lie within the longitudinal central plane 204 of the limb so as not to disrupt the balance of loads and out the center 206 of the axis 205.

Figure 19:
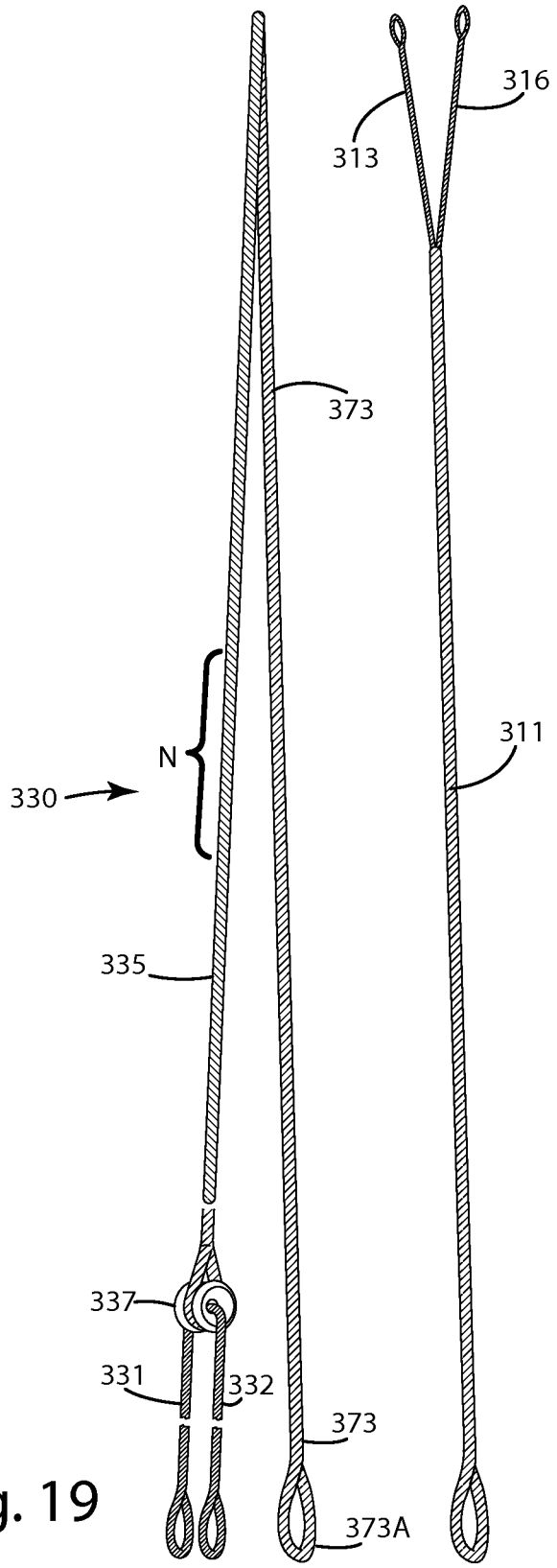
FIG. 19 is a rear perspective view of a bowstring and cable of the second alternative embodiment.

As shown in FIGS. 17-19, the bowstring first and second portions 331 and 332 can track in and be guided by the respective first and second bowstring tracks 261 and 262. These bowstring portions 331 and 332 can be joined with a primary bowstring portion 335. This primary bowstring portion 335 can extend upward to the pulley 220. Wrapping around the pulley 220, the bowstring primary portion transitions to the tertiary bowstring portion 373. This tertiary bowstring portion 373 extends downward, back toward the cam assembly 250. The tertiary portion 373 can include a loop 373A that terminates at its end. The tertiary portion 373 can be guided by and extend within the power cable track 241, optionally forward of the axis of rotation 205 of the lower cam assembly. Generally, the tertiary bowstring portion 373 can operate as a downwardly moving power cable as shown in FIG. 17.

The power cable track 241 can include a power cable let out portion 244 that lets out the tertiary bowstring portion 373 when the bow is drawn during a draw cycle. The power cable track 241 can also include a take up portion 246 that takes up the power cable 311 when the bow is drawn during a draw cycle. The take up portion and let out portion of the power cable track can be substantially continuous with one another, and can lay within the same plane, for example, the longitudinal central plane 204 of the limb and/or the bowstring plane 208. Of course if desired, these track portions can be non-continuous or interrupted.

As the bow is drawn during a draw cycle, the cam assembly 250 rotates in direction 213, with the first and second bowstring portions 331 and 332 are let out optionally rearward to the rear R of the axis of rotation 205. The tertiary bowstring portion 373 is likewise let out from the power cable track 241. The power cable 311 is taken up by the take up portion 246 of the power cable track 241. Simultaneously, the pulley rotates in the direction of the arrow 213. The bowstring primary portion 335 is let out from the pulley let out track 222 to the rear R of the axis of rotation 225. On the front side of the pulley, the tertiary portion 373 is taken up and guided by the take up portion 223 of the pulley track 221. Like the embodiments above, when the bow is at full draw, the configuration of the cam assembly inhibits cam lean out of vertical alignment with bowstring plane 208, and also inhibits twisting of the limb 214.

A bowstring and cable suitable for use with the second alternative embodiment of FIGS. 17 and 18 is illustrated in FIG. 19. The bowstring 330 can include a primary portion 335 having a nocking area N for nocking an arrow thereon. The primary portion 335 can be joined with first and second bowstring portions 331 and 332 via the string joiner 337. The primary portion 335 can be joined with a tertiary bowstring portion 373 that terminates at an end, which optionally can include a loop 373A. The power cable 311 can include a looped end, and opposite that looped end, first and second power cable portions 315 and 316. These first and second power cable portions 315 and 316 can include loops or other fastening mechanisms that enable them to be joined with the axle or other component on the upper limb 215 of the bow 210.

In yet another alternative embodiment, a cam assembly for use with a pulley, another identical cam assembly, or a different cam assembly, can include first and second bowstring tracks similar to that in the embodiment shown in FIGS. 17-18. Likewise, the can assembly can include a power cable track like that in those figures. However, another secondary bowstring track can be located between that power cable track and one of the bowstring tracks. This secondary bowstring track can accommodate another portion of the bowstring.

For example, with reference to FIG. 18, this secondary bowstring track could be located between the cable track 241 and the second bowstring track 262. The additional secondary bowstring track can be of a different shape and/or size from the first and second bowstring tracks. Instead of the tertiary bowstring portion 371 being guided by the power cable track portion 246, or any part of the power cable track 241 for that matter, that tertiary portion could be seated and guided in the additional secondary bowstring track. In this configuration, the additional secondary bowstring track can enable the tertiary bowstring portion to function like a power cable. While this configuration might slightly throw off the balance of forces or loads around the center 206, it still can provide some level of inhibiting limb twist and/or cam lean.

While applications to the two-track binary cam and the single cam systems have been described in the embodiments above, the basic concepts together with the resulting benefits are applicable to other systems including, but not limited to, the "cam and a half" systems, three-track binary cam systems, traditional dual cam systems, eccentric axle dual cam systems, and any other system that uses a cam, a pulley or any rotating element on an archery bow. Further, although the embodiments illustrate the cam assembly and bowstring in connection with a compound bow, the cam assembly and bowstring can be used in connection with a crossbow or any bow including a bowstring and a cable.

The above descriptions are those of the preferred embodiments of the invention. Various alterations and changes can be made without departing from the spirit and broader aspects of the invention as defined in the appended claims, which are to be interpreted in accordance with the principles of patent law including the doctrine of equivalents. Any references to claim elements in the singular, for example, using the articles "a," "an," "the," or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. An archery bow comprising:

a riser;

a first limb joined with the riser;

a second limb spaced from the first limb and joined with the riser;

a first cam assembly mounted to the first limb, the first cam assembly comprising:

a first cam part defining a first bowstring track adapted to guide a first portion of a bowstring;

a second cam part defining a second bowstring track adapted to guide a second portion of a bowstring, the second bowstring track laterally offset from the first bowstring track a preselected distance along an axis of rotation of the first cam assembly; and a first power cable cam defining a first power cable track located between the first bowstring track and the second bowstring track along the axis of rotation of the first cam assembly;

a second cam assembly mounted to the second limb, the second cam assembly comprising:

a third cam part defining a third bowstring track adapted to guide a third portion of a bowstring;

a fourth cam part defining a fourth bowstring track adapted to guide a fourth portion of a bowstring, the fourth bowstring track laterally offset from the third bowstring track a preselected distance along an axis of rotation of the second cam assembly; and a second power cable cam defining a second power cable track located between the third bowstring track and the fourth bowstring track along the axis of rotation of the second cam assembly;

a primary bowstring portion joined with the first portion of the bowstring and with the second portion of the bowstring adjacent the first cam assembly, the primary bowstring portion joined with the third bowstring portion and with the fourth bowstring portion adjacent the second cam assembly, the primary bowstring portion including a nocking area the primary bowstring portion including a loop; a string joiner defining an external groove and a bore which extends through the joiner, the loop of the primary bowstring portion being threaded through the bore of the string joiner;

a down power cable extending from the first power cable cam directly to the second power cable cam, and disposed in the first power cable track of the first power cable cam and in the second power cable track of the second power cable cam;

an up power cable extending from the first power cable cam directly to the second power cable cam and disposed in the first power cable track of the first power cable cam and in the second power cable track of the second power cable cam;

wherein the first power cable cam includes a let-out portion that lets out the down power cable rearward of the axis of rotation of the first cam assembly, and between the first bowstring track and second bowstring track, as the archery bow is drawn;

wherein the second power cable cam includes a let-out portion that lets out the up power cable rearward of the axis of rotation of the second cam assembly, and between the third bowstring track and the fourth bowstring track as the archery bow is drawn;

wherein the first cam part and first power cable cam are formed as a monolithic one piece structure, wherein the second cam part is fastened to the first power cable cam with at least one fastener that projects at least partially through the second cam part, wherein the first power cable track is non-continuous with both the first and second bowstring tracks so that no portion of the bowstring tracks within the first power cable track at any point of the draw cycle of the bow, wherein the first and second bowstring tracks are non-continuous with the first power cable track so that no portion of the power cable tracks within any portion of the first and second bowstring tracks.

* * * * *